US012808561B2

(12) United States Patent
Abraham et al.

(10) Patent No.: US 12,808,561 B2
(45) Date of Patent: Nov. 24, 2026

(54) SCHEDULING MAINTENANCE FOR LOAD CONTROL SYSTEMS

(71) Applicant: Lutron Technology Company LLC, Coopersburg, PA (US)

(72) Inventors: Arya Abraham, Bethlehem, PA (US); Adam J. Andersen, Allentown, PA (US); Timothy Gill, Bethlehem, PA (US)

(73) Assignee: Lutron Technology Company LLC, Coopersburg, PA (US)

( * ) Notice: Subject to any disclaimer, the term of this patent is extended or adjusted under 35 U.S.C. 154(b) by 357 days.

(21) Appl. No.: 18/505,072

(22) Filed: Nov. 8, 2023

(65) Prior Publication Data

US 2024/0151416 A1 May 9, 2024

Related U.S. Application Data

(60) Provisional application No. 63/423,791, filed on Nov. 8, 2022.

(51) Int. Cl.

| | |
|---|---|
| ***F24F 11/49*** | (2018.01) |
| *F24F 120/10* | (2018.01) |
| *F24F 140/50* | (2018.01) |

(52) U.S. Cl.

CPC ..... *F24F 11/49* (2018.01); *F24F 2120/10* (2018.01); *F24F 2140/50* (2018.01)

(58) Field of Classification Search

None

See application file for complete search history.

(56) References Cited

U.S. PATENT DOCUMENTS

| | | | | |
|---|---|---|---|---|
| 8,571,719 | B2 | 10/2013 | Altonen et al. | |
| 8,665,090 | B2 | 3/2014 | Bull | |
| 8,975,778 | B2 | 3/2015 | Altonen et al. | |
| 9,590,453 | B2 | 3/2017 | Bull et al. | |
| 10,098,074 | B2 | 10/2018 | Baker et al. | |
| 10,965,639 | B2 | 3/2021 | Anderson et al. | |
| 11,360,502 | B2 | 6/2022 | Dolan | |
| 2005/0222889 | A1* | 10/2005 | Lai | G06Q 10/06 705/7.41 |
| 2008/0229226 | A1 | 9/2008 | Rowbottom et al. | |
| 2009/0177601 | A1* | 7/2009 | Huang | H04L 67/535 706/16 |
| 2014/0282172 | A1 | 9/2014 | Bull et al. | |

(Continued)

FOREIGN PATENT DOCUMENTS

| | | | |
|---|---|---|---|
| EP | 4016203 | A1 | 6/2022 |

*Primary Examiner* — Paul B Yanchus, III

(74) *Attorney, Agent, or Firm* — Flaster Greenberg, P.C.

(57) ABSTRACT

Systems, methods, and apparatus are described herein for enabling performance of maintenance tasks on one or more load control devices in a load control system. An indication of maintenance task may be received, from a cloud server, at a local controller configured to control the one or more load control devices in one or more rooms of a building. The local controller may identify triggering criteria for triggering a performance of the maintenance task on one or more load control devices in the one or more rooms of the building. The local controller may determine that the triggering criteria of the at least one rule has been met and perform the maintenance task on the one or more load control devices in the one or more rooms of the building.

36 Claims, 9 Drawing Sheets

(56) References Cited

U.S. PATENT DOCUMENTS

| | | | | |
|---|---|---|---|---|
| 2015/0295803 | A1 | 10/2015 | Jung | |
| 2016/0321061 | A1* | 11/2016 | Walter | G06F 8/65 |
| 2018/0095142 | A1* | 4/2018 | Nelson | G01R 31/44 |
| 2018/0267794 | A1* | 9/2018 | Atchison | F24F 11/58 |
| 2019/0095644 | A1 | 3/2019 | Park et al. | |
| 2021/0029202 | A1 | 1/2021 | Banerjee et al. | |
| 2024/0126529 | A1* | 4/2024 | Fuchs | G06F 8/65 |

* cited by examiner

SCHEDULING MAINTENANCE FOR LOAD CONTROL SYSTEMS

CROSS-REFERENCE TO RELATED APPLICATIONS

This application claims the benefit of U.S. Provisional Patent Application No. 63/423,791, filed Nov. 8, 2022, the disclosure of which is incorporated herein by reference in its entirety.

BACKGROUND

A user environment, such as a residence, an office building, or a hotel for example, may be configured using various types of load control systems. A lighting control system may be used to control the lighting loads in the user environment. A motorized window treatment control system may be used to control the natural light provided to the user environment. An HVAC system may be used to control the temperature in the user environment. Each load control system may include various control devices.

SUMMARY

Control devices in a load control system may need to be maintained and maintenance of the control devices may cause the electrical loads in the user environment to be automatically controlled according to settings that are not input by the occupant or another user into the system, or that cause the electrical loads to be inoperable for an intended purpose by the occupant or other user. Certain maintenance may even need to be performed at specific time periods or times of day that may be challenging to avoid interrupting the control of the occupant or other users.

Systems, methods, and apparatus are described herein for enabling performance of maintenance tasks on one or more load control devices in a load control system. A maintenance task may be received at a local maintenance supervisor on a local controller configured to control the one or more load control devices in one or more rooms of a building. The local maintenance supervisor on the local controller may identify triggering criteria for triggering a performance of the maintenance task on one or more load control devices in the one or more rooms of the building. The local maintenance supervisor on the local controller may determine that the triggering criteria has been met and perform the maintenance task on the one or more load control devices in the one or more rooms of the building. The local maintenance supervisor on the local controller may determine the results of the maintenance task performed on the one or more load control devices.

The maintenance task may be received from a cloud maintenance supervisor being executed on a cloud server. The cloud maintenance supervisor may be configured to coordinate scheduling of maintenance tasks at a plurality of local controllers. The local maintenance device may send the results of the maintenance task to the cloud maintenance supervisor.

The local controller may control the one or more load control devices in a single room of the building. The local controller may be a first local controller and the single room of the building may be a first room of the building. A local maintenance supervisor on a second local controller may receive the maintenance task configured to control one or more load control devices in a second room of the building. The local maintenance supervisor on the second local controller may identify the triggering criteria for triggering the performance of the maintenance task on the one or more load control devices in the second room of the building. The local maintenance supervisor on the second local controller may determine that the triggering criteria of the at least one rule has been met. The maintenance task may be performed on the one or more load control devices in the second room of the building.

A cloud maintenance supervisor may determine that a maintenance event has been scheduled in response to input from a user device. The maintenance event may comprise the maintenance task and the triggering criteria. The maintenance task and the triggering criteria may be transmitted from the cloud maintenance supervisor to the local maintenance supervisor on the local controller.

The maintenance task may comprise programming updates, firmware updates, recalibration of control devices, or testing to verify the system performance. The triggering criteria may comprise rules defined by one or more parameters that include one or more of a checked-in status, an occupancy status, a time of day, a period of time since last occupancy, a period of time since a change in the checked-in status, a period of time since last performance of the maintenance task, an indication of an override, a daylight intensity value, a temperature of a room, a temperature outside of the room/building, a lighting intensity value, a status of a load control device, a status of an electrical load, and/or a status of an occupant.

DETAILED DESCRIPTION

Figure 1:
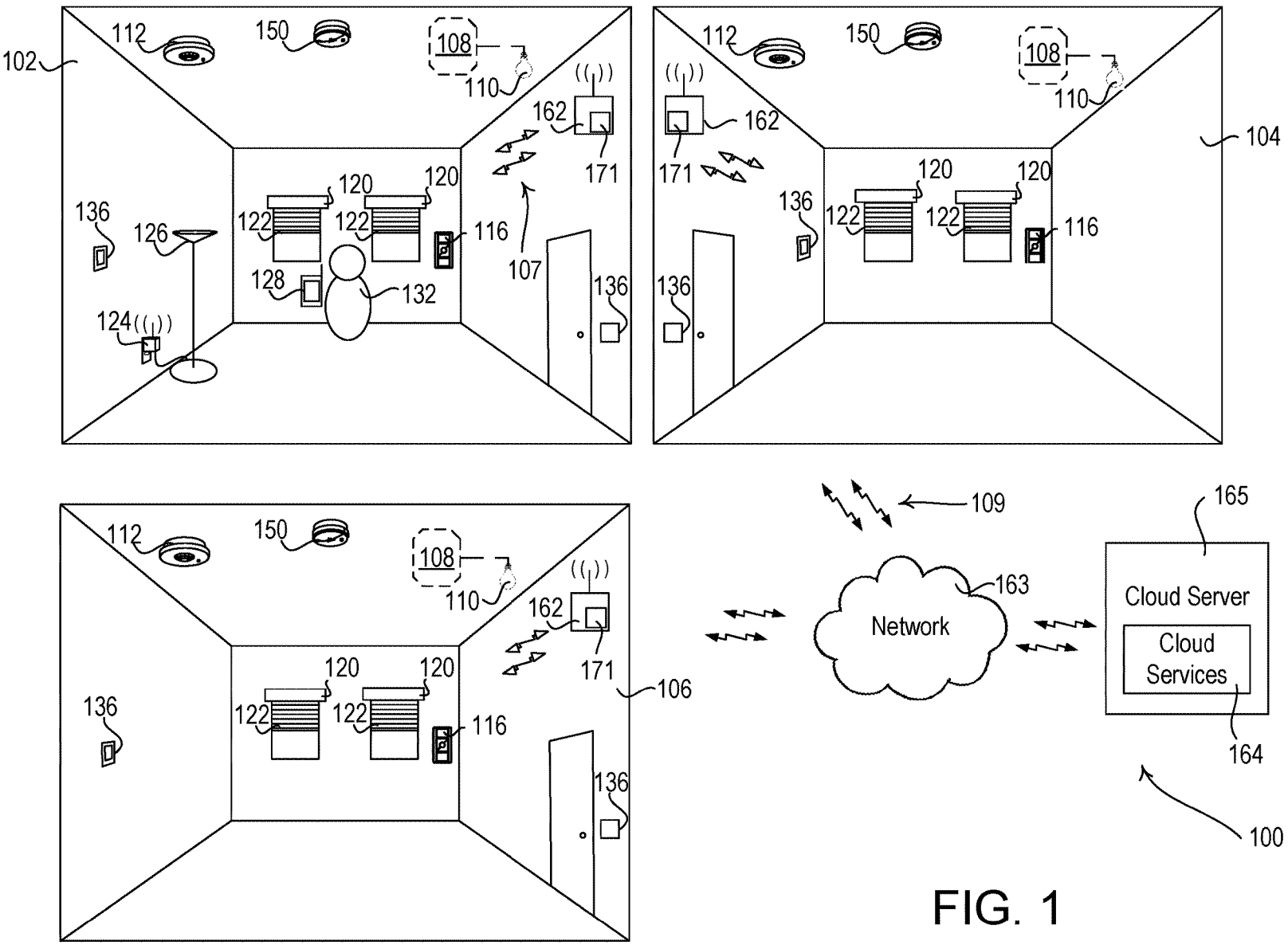
FIG. 1 depicts a representative environment for controlling one or more electrical loads.

FIG. 1 depicts a representative environment for controlling one or more electrical loads installed in one or more defined spaces, such as a room, a portion of a room (e.g., cubicle), a building, a portion of a building (e.g., a hallway, a stairwell, a portion of a conference room, a lobby or other a common area, etc.), and/or another defined space in a building. As shown in FIG. 1, rooms 102, 104, and 106 of a building may be installed with one or more load control devices for controlling the electrical loads within a defined space. The defined space may be a room and/or building. In one example, the rooms 102, 104, 106 may be hotel rooms, offices, rooms in a home, and/or other rooms in a residential and/or commercial building. Each of the load control devices in the rooms 102, 104, 106 may be configured to control (e.g., directly control) an amount of power provided to an electrical load. For example, the load control devices may control an amount of power provided to the electrical load power from an alternating current (AC) power source or a direct current (DC) power source. The load control devices may each be controlled by one or more input devices. Example load control devices may include lighting devices, such as, lighting control devices 108 (e.g., light-emitting diode (LED) drivers, dimmer switches, and/or electronic switches) for controlling the amount of power provided to lighting loads 110. The lighting control devices 108 may be configured to control the respective lighting loads 110, which may be installed in respective lighting fixtures. For example, the lighting control devices 108 may comprise light-emitting diode (LED) drivers and the lighting loads 110 may comprise LED light sources. Though described as an LED driver, the lighting control devices 108 may be a dimmer, an electronic switch, a ballast, or another type of lighting control device configured to control one or more lighting loads 110. The lighting control devices 108 may be configured to directly control the amount of power provided to the respective lighting loads 110. The lighting control devices 108 may be configured to receive (e.g., via wired or wireless communications) messages via signals 107,109, and to control the respective lighting load 110 in response to the received messages. One will recognize that lighting control devices 108 and corresponding lighting loads 110 may be integral and thus part of the same fixture or bulb, for example, or may be separate. A lighting control device may also control more than one lighting load in one or more fixtures.

As described herein, a lighting control device, such as the lighting control devices 108 may control an amount of power provided from an AC power source or a DC power source to a lighting load (e.g., or a plurality of lighting loads), such as the respective lighting loads 110, where the lighting load may include a plurality of multi-colored LED light sources. In other words, the lighting loads 110 may include within a single package, for example, a number of differently colored emission LEDs and may be configured such that the chromaticity output of the LEDs is mixed to produce light having varying chromaticity coordinates (e.g., color points) within a color gamut formed by the various LEDs that make up the lighting load. As one example, the lighting loads 110 may each include one or more red LEDs, one or more green LEDs, one or more blue LEDs, and one or more white LEDs (e.g., which may be collectively referred to herein as an RGBW lighting load). White LEDs may comprise substantially white LEDs (e.g., such as yellow and/or mint green LED(s)). Although the RGBW lighting load is described herein with a combination of four LEDs of certain colors, other combinations of LEDs (e.g., more or less LEDs and/or different color LEDs) may be used.

The lighting control devices 108 may each adjust various settings of the corresponding lighting load 110 to adjust the light emitted from the lighting load 110. For example, the lighting control device 108 may adjust lighting settings, such as the lighting intensity level (i.e., brightness), the color (e.g., correlated color temperature (CCT) value or full color value), the value of a vibrancy parameter affecting color saturation, and/or another setting of a lighting load, which are further described herein. Further, the lighting control devices 108 may each adjust the settings of lighting load(s) over time (e.g., according to a timeclock schedule, which schedule may be referred to as natural show or natural lighting). For example, the lighting control devices 108 may adjust the settings of the respective lighting loads 110 (e.g., color and/or intensity) over time to emulate a sunrise and/or sunset, which may be based on the local time of sunrise and/or sunset for the load control system 100.

Each lighting control device 108 and respective lighting load 110 may be configured to produce white or near-white light of varying brightness/intensities within a range of CCTs ranging from "warm white" (e.g., roughly 2600 Kelvin (K)-3700 K), to "neutral white" (e.g., 3700 K-5000 K) to "cool white" (e.g., 5000 K-8300 K). For example, the lighting control devices 108 and respective lighting load 110 may be configured to produce light of varying chromaticity coordinates that lie along the black body locus or curve. As a further example, such a lighting control device 108 and its respective lighting load 110 may be further configured to produce any of a plurality of colors of varying brightness/intensities within the color gamut formed by the various LEDs that make up the lighting load 110.

Each lighting control device 108 and its respective lighting load 110 may be configured to increase and/or decrease a color saturation of objects in the corresponding room 102, 104, or 106. For example, the lighting control device 108 may control or be responsive to a vibrancy parameter that is configured to control the color saturation of the objects in the corresponding room 102, 104, or 106. The vibrancy parameter may allow the lighting control device 108 to tune the individual colors that make light at a given color (e.g., full color or a CCT). The vibrancy parameter may cause the lighting control device 108 to control the power provided to the LEDs of the corresponding lighting load 110 to adjust the wavelength of the light emitted by the lighting load 110, which may affect the color of the light (e.g., the reflected light) on objects within the corresponding room 102, 104, or 106. Increases and decreases in the value of the vibrancy parameter may increase/decrease the color saturation of objects in the area without changing the color of the visible light output when the user 132 looks at the light (e.g., the color of the emitted light). In an example, the vibrancy parameter may be a relative value (e.g., between zero and one-hundred percent) for increasing/decreasing the color saturation of the objects in the corresponding room 102, 104, or 106. Changing the relative value of the vibrancy parameter may cause the lighting control devices 108 to decrease or increase the intensity of one or more white LEDs (e.g., white or substantially white LEDs) that make up the respective lighting loads 110. For example, increasing the value of the vibrancy parameter may thereby decrease the intensity of the one or more white LEDs that make up the respective lighting loads 110, and thereby increase the color saturation of the objects in the corresponding room 102, 104, or 106. Decreasing the value of the vibrancy parameter may thereby increase the intensity of the one or more white LEDs that make up the respective lighting loads 110, and thereby decrease the color saturation of the objects in the corresponding room 102, 104, or 106. Changing the value of the vibrancy parameter in this manner may also include changing the intensities of other LEDs (e.g., red, green, and/or blue LEDs) of the lighting loads 110 to maintain the same color output of the lighting loads 110 (e.g., to maintain the same (or approximately the same within one or more MacAdam ellipses) chromaticity coordinates of the mixed color output of the lighting loads 110). Adjusting the vibrancy value may, however, adjust the light reflected off of objects in the space. In addition, adjusting the vibrancy value may adjust spectral power distribution (SPD) of the light. For example, as the vibrancy value increases, an SPD curve of the emitted light (e.g., relative intensity vs wavelength) may become sharper and/or may result in individual colors on the objects to appear more vibrant when the light reflects off of them. One example of a lighting control device and respective lighting load is described as illumination device 38 of U.S. Pat. No. 10,237,945, issued Mar. 19, 2019, entitled ILLUMINATION DEVICE, SYSTEM AND METHOD FOR MANUALLY ADJUSTING AUTOMATED PERIODIC CHANGES IN EMULATION OUTPUT, the contents of which are hereby incorporated by reference in their entirety. One will recognize that other examples lighting control device and respective lighting loads are possible.

The light emitted by the lighting loads 110 may be measured by a color rendering index (CRI) value. The CRI value may be a measurement of the lighting load's 110 ability to reveal the actual color of objects as compared to an ideal light source (e.g., natural light). A higher CRI value may be a desirable characteristic of a user. For example, a lighting load with a higher CRI value may provide light such that the objects within a space reflect light at a natural color. With respect to the lighting loads described herein, each of the respective LEDs that are comprised within a RGBW lighting load may be defined by a certain CRI value. In addition, an RGBW lighting load, for example, itself may be defined by a CRI value (e.g., a CRI value that indicates a summary or average CRI of each of the respective LEDs comprised within the lighting load). CRI values may be in the range of 0 to 100, inclusively. For example, the lowest possible CRI value may be 0 and the highest possible CRI value may be 100. A CRI value greater than or equal to a threshold (e.g., a CRI value of 90) may be desirable and may be referred to herein as "optimal", "optimized", or "maximized". That said, other ranges (e.g., smaller and/or larger ranges) may also be considered "optimal", "optimized", or "maximized". In certain instances, the CRI value of a lighting load may be increased to a value greater than or equal to a threshold CRI value. For example, the threshold CRI value may be 90. One will appreciate, however, that the threshold CRI value may be other values. Rather, the CRI threshold value may be a value which may be considered a desirable threshold that a system may attempt to achieve give the certain characteristics of the load control system 100 and/or lighting control devices 108 (e.g., quality of the LEDs used in a lighting load). As described herein, optimizing the CRI value towards or above the threshold CRI value may be referred to as optimizing the CRI value.

Each lighting control device 108 may be configured to receive messages via radio frequency (RF) signals, such as the RF signals 107,109, and/or via a wired communication link. Each lighting control device 108 may adjust one or more settings of the respective lighting load 110 in response to the received messages. Each lighting control device 108 may transmit a status message(s) via the RF signals 107, 109 and/or the wired communication link indicating a status of one or more settings of the respective lighting load 110 to other devices in the load control system.

One or more of the lighting control devices 108 may be installed in an emergency lighting fixture in the load control system 100. In these emergency lighting fixtures, the lighting control devices 108 may need to operate from battery power to control the corresponding lighting load 110. In an emergency situation, or during a maintenance task that is performed to test the emergency lighting fixture, the lighting control devices 108 that control an emergency lighting fixture may draw on the battery power for controlling the lighting load to a predefined intensity and/or color. The lighting control devices 108 may recharge the battery power from the AC power source after the batter power has been discharged and/or power returns from the AC power source.

With regard to other load control devices in the load control system 100, the load control system 100 may comprise one or more daylight control devices, such as motorized window treatments 120. The motorized window treatments 120 may comprise motorized cellular shades, for controlling the amount of daylight entering the corresponding room 102, 104, or 106. Each motorized window treatment 120 may comprise a window treatment fabric 122 hanging from a headrail in front of a respective window. Each motorized window treatment 120 may further comprise a motor drive unit (not shown) located inside of the headrail, for example, for raising and lowering the window treatment fabric 122 for controlling the amount of daylight entering the corresponding room 102, 104, or 106. The motor drive units of the motorized window treatments 120 may be configured to receive messages via the RF signals 107,109 and adjust the position of the respective window treatment fabric 122 in response to the received messages. The motor drive units of the motorized window treatments 120 may also or alternatively be configured to receive messages via a wired communication link, and adjust the position (e.g., raise, lower, etc.) of the respective window treatment fabric 122 in response to the received messages. The motorized window treatments may be battery-powered or powered by an AC power source. The load control system 100 may comprise other types of daylight control devices, such as, for example, a cellular shade, a drapery, a Roman shade, a Venetian blind, a Persian blind, a pleated blind, a tensioned roller shade system, an electrochromic or smart window, and/or other suitable daylight control device, any of which may be motorized and controlled via a wired or wireless communication link. Examples of battery-powered motorized window treatments are described in greater detail in U.S. Pat. No. 8,950,461, issued Feb. 10, 2015, entitled MOTORIZED WINDOW TREATMENT, and U.S. Pat. No. 9,488,000, issued Nov. 8, 2016, entitled INTEGRATED ACCESSIBLE BATTERY COMPARTMENT FOR MOTORIZED WINDOW TREATMENT, the entire disclosures of which are hereby incorporated by reference. Daylight control devices, such as the motorized window treatment 120 may transmit a status message(s) via a wired communication link and/or the RF signals 107, 109 indicating the level of the covering material 122, a fully-open/fully-closed status, and/or another status of the covering material 122 and/or motorized window treatment 120 to other devices in the load control system.

The load control devices in the load control system 100 may comprise one or more plug-in load control devices such as plug-in load control device 124 for controlling one or more plug-in electrical loads. A plug-in electrical load may comprise a plug-in lighting load, such as a floor lamp 126 or a table lamp. A plug-in electrical load may comprise an appliance (such as a television or a computer monitor). The floor lamp 126 may be plugged into the plug-in load control device 124 for receiving power and/or enabling control. The plug-in load control device 124 may be plugged into a standard electrical outlet and thus may be coupled in series between an AC power source for example, and the plug-in electrical load. The plug-in load control device 124 may be configured to receive messages via a wired communication link and/or the RF signals 107, 109 to control the plug-in electrical load, such as to turn on and off or adjust the intensity, color, vibrancy, and/or another setting of the floor lamp 126 in response to the received messages. The plug-in load control device 124 may transmit a status message(s) via a wired communication link and/or via the RF signals 107, 109 indicating the status of the plug-in electrical load, such as the on/off status, intensity, color, vibrancy, and/or another setting of the floor lamp 126 to other devices in the load control system.

The load control devices in the load control system 100 may comprise one or more temperature control devices, such as a thermostat 136, for controlling a temperature in corresponding rooms 102, 104, and 106. The thermostats 136 may each be coupled to a heating, ventilation, and air conditioning (HVAC) system(s) via a control link. The control link may be an analog control link or a wired or wireless digital communication link. The thermostats 136 may each be configured to communicate messages with a controller of the HVAC system(s) via the control link. Each thermostat 136 may comprise a temperature sensor for measuring the room temperature of the corresponding rooms 102, 104, and 106 and may control the HVAC system(s) to adjust the temperature in the corresponding rooms 102, 104, and 106 to a setpoint temperature. The load control system 100 may comprise one or more wireless and/or wired temperature sensors (not shown) located in the corresponding rooms 102, 104, and 106 for measuring the room temperatures via a temperature control device. The HVAC system(s) may be configured to turn a compressor on and off for cooling the corresponding rooms 102, 104, and 106 and to turn a heating source on and off for heating the corresponding rooms 102, 104, and 106 in response to the control signals received from a temperature control device, such as thermostat 136. The HVAC system(s) may be configured to turn a fan of the HVAC system on and off in response to the control signals received from temperature control device, such as thermostat 136. The temperature control device, such as thermostat 136, and/or the HVAC system(s) may be configured to control one or more controllable dampers to control the air flow in the corresponding rooms 102, 104, and 106. The temperature control device, such as thermostat 136, may be configured to receive messages via a wired communication link and/or the RF signals 107, 109 and adjust heating, ventilation, and cooling in response to the received messages. The temperature control device, such as thermostat 136, may transmit a status message(s) via a wired communication link and/or the RF signals 107, 109 indicating the setpoint temperature, an on/off status, or another status of the HVAC system(s) to other devices in the load control system.

The load control system 100 may comprise one or more other types of load control devices that may be controllable via a wired communication link and/or the RF signals 107, 109, such as, for example, a screw-in luminaire including a dimmer circuit and an incandescent or halogen lamp; a screw-in luminaire including a ballast and a compact fluorescent lamp; a screw-in luminaire including an LED driver and an LED light source; an electronic switch, controllable circuit breaker, or other switching device for turning an appliance on and off; a motor control unit for controlling a motor load, such as a ceiling fan or an exhaust fan; a drive unit for controlling a projection screen; motorized interior or exterior shutters; an air conditioner; a compressor; an electric baseboard heater controller; a controllable damper; a variable air volume controller; a fresh air intake controller; a ventilation controller; hydraulic valves for use radiators and radiant heating system; a humidity control unit; a humidifier; a dehumidifier; a water heater; a boiler controller; a pool pump; a refrigerator; a freezer; a television or computer monitor; a video camera; an amplifier; an elevator; a power supply; a generator; an electric charger, such as an electric vehicle charger; an alternative energy controller; and/or another type of load control device.

The load control system 100 may comprise one or more input devices configured to receive an input event for controlling one or more load control devices in the load control system 100. The input devices and the load control devices may be collectively referred to as control devices in the load control system 100. The input devices in the load control system 100 may comprise one or more control devices 116, such as remote control devices. The control devices 116 may each be AC or DC powered, such as battery-powered. The control devices 116 may each be configured to transmit messages via a wired communication link and/or the RF signals 107 to one or more other devices in the load control system 100 in response to an input event, such as an actuation of one or more buttons or a rotation of a rotary knob of the control device 116. For example, the control devices 116 may each comprise a keypad. In another example, the control devices 116 may each comprise a rotary knob configured to transmit messages via a wired communication link and/or the RF signals 107 to one or more other devices in response to a rotation on the rotary knob (e.g., rotation of a predefined distance or for a predefined period of time). The control devices 116 may be mounted to a structure, such as a wall, a toggle actuator of a mechanical switch, or a pedestal to be located on a horizontal surface. In another example, one or more control devices 116 may be handheld. The control devices 116 may each provide feedback (e.g., visual feedback) to a user of the control device 116 on a visual indicator, such as a status indicator. The status indicator may be illuminated by one or more light emitting diodes (LEDs) for providing feedback. The status indicator may provide different types of feedback. The feedback may include feedback indicating actuations by a user or other user interface event, a status of electrical loads being controlled by the control device 116, and/or a status of the load control devices being controlled by the control device 116. The feedback may be displayed in response to user interface event and/or in response to messages received that indicate the status of load control devices and/or electrical loads. Examples of battery-powered remote control devices are described in greater detail in commonly-assigned U.S. Pat. No. 8,330,638, issued Dec. 11, 2012, entitled WIRELESS BATTERY-POWERED REMOTE CONTROL HAVING MULTIPLE MOUNTING MEANS, and U.S. Patent Application Publication No. 2012/0286940, published Nov. 15, 2012, entitled CONTROL DEVICE HAVING A NIGHTLIGHT, the entire disclosures of which are hereby incorporated by reference.

The input devices of the load control system 100 may comprise one or more sensor devices, such as occupancy sensor devices 112 and/or daylight sensor devices 150. The sensor devices may be configured to transmit messages via the RF signals 107 to one or more other devices in the load control system 100 in response to an input event, such as a sensor measurement event. The sensor devices may also or alternatively be configured to transmit messages via a wired communication link to one or more other devices in the load control system 100 in response to an input event, such as a sensor measurement event. The daylight sensor devices 150 may each operate as an ambient light sensor or a daylight sensor and may be configured to perform a sensor measurement event by measuring a total light intensity in the corresponding rooms 102, 104, 106. The daylight sensor devices 150 may each transmit messages including the measured light level or control instructions in response to the measured light level via a wired communication link and/or the RF signals 107. Examples of RF load control systems having daylight sensors are described in greater detail in commonly assigned U.S. Pat. No. 8,410,706, issued Apr. 2, 2013, entitled METHOD OF CALIBRATING A DAYLIGHT SENSOR; and U.S. Pat. No. 8,451,116, issued May 28, 2013, entitled WIRELESS BATTERY POWERED DAYLIGHT SENSOR, the entire disclosures of which are hereby incorporated by reference.

The occupancy sensor devices 112 may each operate as an occupancy sensor configured to detect occupancy conditions, as a vacancy sensor configure to detect vacancy conditions, and/or both in each of the corresponding rooms 102, 104, 106. The occupancy sensor devices 112 may be configured to perform the sensor measurement event by measuring an occupancy condition and/or a vacancy condition in response to occupancy or vacancy, respectively, of the corresponding room 102, 104, or 106 by the user 132. For example, the occupancy sensor devices 112 may each comprise an infrared (IR) sensor configured to detect the occupancy condition and/or the vacancy condition in response to the presence or absence, respectively, of the user 132. The occupancy sensor devices 112 may each transmit messages including the occupancy conditions or vacancy conditions, or control instructions generated in response to the occupancy/vacancy conditions, via the RF signals 107. Again, the occupancy sensor devices 112 may also or alternatively transmit messages including the occupancy conditions or vacancy conditions, or control instructions generated in response to the occupancy/vacancy conditions, via a wired communication link. Examples of load control systems having occupancy and vacancy sensors are described in greater detail in commonly-assigned U.S. Pat. No. 8,228,184, issued Jul. 24, 2012, entitled BATTERY-POWERED OCCUPANCY SENSOR, U.S. Pat. No. 8,009,042, issued Aug. 30, 2011, entitled RADIO-FREQUENCY LIGHTING CONTROL SYSTEM WITH OCCUPANCY SENSING, and U.S. Pat. No. 8,199,010, issued Jun. 12, 2012, entitled METHOD AND APPARATUS FOR CONFIGURING A WIRELESS SENSOR, the entire disclosures of which are hereby incorporated by reference.

The input devices in the rooms 102, 104, 106 may include an access point device 136. The access point device 136 may be activated by an access key, such as a keycard or another type of access key. The user device 128 may operate as an access key for activating the access point device 136. For example, when the access key comes within a certain distance, for example, of the access point device a signal of the access key may be received by the access point device 136 at a certain signal strength, or a signal of the access point device 136 may be received by the access key at a certain signal strength, and the access point device 136 may receive a unique identifier of the access key and determine that the access key includes the proper unique identifier to open the door to the respective room 102, 104, 106. In an example, the access key and the access point device 136 may utilize RFID or NFC signals to detect the signal strength of each other. Each activation of the access point device 136 by the access key may be tracked in system configuration data that may include configuration/control for the load control system 100, as further described herein. Activation of the access point device 136 may indicate that the respective room 102, 104, 106 is occupied. The load control devices in the load control system 100 may be automatically controlled to preconfigured states in response to the activation of the access point device 136.

The load control system 100 may comprise other types of input devices, such as, for example, wall controls that are configured to receive messages via RF or wired communications and are hardwired to control electrical loads (e.g., lighting loads, motorized window treatments, etc.), visible light sensors, temperature sensors, humidity sensors, radiometers, cloudy-day sensors, shadow sensors, pressure sensors, smoke detectors, carbon monoxide detectors, air-quality sensors, motion sensors, security sensors, proximity sensors, fixture sensors, partition sensors, multi-zone control units, slider control units, kinetic or solar-powered remote controls, key fobs, cell phones, smart phones, tablets, personal digital assistants, personal computers, laptops, time-clocks, audio-visual controls, safety devices, power monitoring devices (e.g., such as power meters, energy meters, utility submeters, utility rate meters, etc.), central control transmitters, residential controllers, commercial controllers, industrial controllers, and/or another type of input device.

The input devices and the load control devices may be configured to communicate messages between one another on a communication link within the load control system 100. For example, the input devices and the load control devices may be configured to communicate messages directly to one another via the RF signals 107. The RF signals 107 may be transmitted using a proprietary RF protocol, such as the CLEAR CONNECT protocol (e.g., CLEAR CONNECT TYPE A and/or CLEAR CONNECT TYPE X protocols). Alternatively, the RF signals 107 may be transmitted using a different RF protocol, such as, a standard protocol, for example, one of WIFI, cellular (e.g., 3G, 4G LTE, 5G NR, or other cellular protocol), BLUETOOTH, BLUETOOTH LOW ENERGY (BLE), ZIGBEE, Z-WAVE, THREAD, KNX-RF, MATTER, ENOCEAN RADIO protocols, or a different proprietary protocol. In an example, the input devices may transmit messages to the load control devices via the RF signals 107 that comprise input events (e.g., button presses, sensor measurement events, or other input event) or control instructions generated in response to the input events for performing control of the electrical loads controlled by the load control devices. Though communication links may be described as a wireless communication links, wired communication links may similarly be implemented for enabling communications herein.

For devices in the load control system 100 to recognize messages directed to the device and/or to which to be responsive, the devices may be associated with one another by performing an association procedure. For example, for a load control device to be responsive to messages from an input device, the input device may first be associated with the load control device. As one example of an association procedure, devices may be put in an association mode for sharing a unique identifier for being associated with and/or stored at other devices in the load control system 100. For example, an input device and a load control device may be put in an association mode by the user 132 actuating a button on the input device and/or the load control device. The actuation of the button on the input device and/or the load control device may place the input device and/or the load control device in the association mode for being associated with one another. The input device and/or the load control device may also, or alternatively, enter the association mode in response to a triggering message received from another device, such as the user device 128. In the association mode, the input device and/or the load control device may exchange messages. For example, the input device may transmit an association message(s) to the load control device (directly or through one or more other devices as described herein). The association message from the input device may include a unique identifier of the input device. The load control device may locally store the unique identifier of the input device in association information, such that the load control device may be configured to recognize messages (e.g., subsequent messages) from the input device that may include the unique identifier of the input device and load control instructions or commands. The association information stored at the load control device may include the unique identifiers of the devices with which the load control device is associated. The load control device may be configured to respond to the messages from the associated input device by controlling a corresponding electrical load according to the load control instructions received in the messages. The input device may also store a unique identifier of the load control device with which it is being associated in association information stored locally thereon. A similar association procedure may be performed between other devices in the load control system 100 to enable each device to perform communication of messages with associated devices. This is merely one example of how devices may communicate and be associated with one another and other examples are possible.

According to another example, one or more devices may receive system configuration data (e.g., or subsequent updates to the system configuration data) that is uploaded to the devices and that specifies the association information comprising the unique identifiers of the devices for being associated. The system configuration data may comprise a load control dataset that defines the devices and operational settings of the load control system 100. The system configuration data may include information about the devices in one or more of the rooms 102, 104, 106 and/or the load control system 100. The system configuration data may include association information that indicates defined associations between devices in the load control system. The association information may be updated using any of the association procedures described herein.

The load control system 100 may include one or more intermediary devices that may maintain the system configuration data that includes the unique identifiers that make up the associations of devices and/or the configuration of devices in the load control system 100. For example, the input devices and the load control devices may communicate on a communication link in the load control system 100 through one or more intermediary devices. The association information that is maintained in the system configuration data may comprise the unique identifiers of the devices that are associated with one another in each room 102, 104, 106 for identifying and/or enabling communication of messages between devices in the load control system 100. For example, each intermediary device may identify the unique identifiers being transmitted in association messages between devices during the association procedure and store the unique identifiers of the devices as an association in the association information. In another example, the intermediary device may receive the unique identifiers of associated devices in the association information from one or more other devices in the load control system 100.

The load control system 100 may include one or more local controllers 162 (e.g., a local hub device), which may operate as intermediary devices. For example, each local controller 162 may operate as a central processing device for one or more control devices (e.g., input devices and/or load control devices) in one or more rooms 102, 104, 106 in the load control system 100. As shown in FIG. 1, each of the rooms 102, 104, 106 may include a separate one of the local controllers 162 that stores the system configuration data for the input devices and the load control devices in the room. In some examples, one of the local controllers 162 may be configured with the system configuration data for the input devices and the load control devices in multiple rooms. Each of the local controllers 162 may be configured to communicate messages to and from the control devices (e.g., the input devices and the load control devices) using the system configuration data stored thereon. For example, each of the local controllers 162 may be configured to receive messages from input devices and transmit messages to load control devices in response to the messages received from the input devices using the system configuration data. Each of the local controllers 162 may include system configuration data for one or more input devices and load control devices for one or more rooms, such as the rooms 102, 104, 106. Each of the local controllers 162 may transmit the messages based on the association information stored in the system configuration data stored thereon. The input devices, the load control devices, and the local controllers 162 may be configured to transmit and receive messages via the RF signals 107 and/or via a wired communication link. Though the local controllers 162 are each provided as being a central processing device for one or more control devices in room 102, 104, 106, a local controller 162 may be programmed for controlling one or more control devices installed in one or more predefined other spaces or areas of a building, such as a room, multiple rooms (e.g., including a room and a common area), a portion of a room (e.g., cubicle, portion of a conference room, or other portion of a room), and/or another portion of a building (e.g., a hallway, a stairwell, a portion of a conference room, a lobby or other a common area, etc.).

Each of the local controllers 162 may receive information in messages from devices in the load control system 100 (e.g., input data from the input devices) via the RF signals 107, for example, and generate corresponding control instructions (e.g., commands) for performing control at one or more load control devices. For example, one of the local controllers 162 may receive an indication of a button press in a message from the control device 116 or an indication of a sensor measurement in a message from a sensor device and interpret the input data in these messages to generate control instructions based on control settings defined in the system configuration data of the load control system 100. For example, the control device 116 in the room 102 may transmit a message that indicates an actuation of a button to the local controller 162 in the room 102, which may receive the message indicating the actuation and identify the button that was actuated to generate corresponding control instructions based on the control settings defined in the system configuration data stored at the local controller 162 in the room 102. The local controller 162 in the room 102 may then transmit one or more messages including the control instructions to one or more load control devices in the room 102 for causing the load control devices in the room 102 to then control their respective electrical loads in the room 102. In another example, the local controller 162 in the room 102 may forward the input data received from an input device to one or more load control devices in room 102. Thus, the local controllers 162 may each transmit the messages comprising the input data based on the association information stored thereon, and the input devices and/or the load control devices themselves may interpret the input data to generate the control instructions. According to another example, the input devices may directly communicate with the load control devices without the assistance of the local controllers 162. The local controllers 162 may still monitor such communications between the control devices by receiving and analyzing the messages communicated between the control devices.

According to a further example, the local controllers 162 may each communicate messages with the input devices and/or the load control devices. Such communications by the local controllers 162 may include system configuration data (e.g., including control settings) for the control devices, such as configuring scene buttons on light switches. Communications from the local controllers 162 may be generated based on the system configuration data and also include, for example, messages directed to load control devices and that include control instructions or commands for the load control devices to control respective electrical loads in response to the received messages. For example, the local controllers 162 may communicate messages to control lighting intensity levels, to control lighting color, to change positions of the window fabric 122, to control the temperature via HVAC settings, etc. Thus, each local controller 162 may operate as a control device or input device itself, by generating the control instructions thereon in response to one or more triggering events (e.g., timeclock events and/or other local triggering events) to send messages to the load control devices to control the corresponding electrical loads in the load control system 100. The local controllers 162 may also, or alternatively, send a message to a load control device that causes the load control device to operate locally stored settings or control instructions.

The load control system 100 of FIG. 1 may be configured such that the local controllers 162 are each configured to communicate with one or more user devices 128. The user device 128 may be a computing device executing software for enabling configuration and/or control of one or more devices in the load control system 100. The user device 128 may be used within a close vicinity to a local controller 162, such that the two may directly communicate in a point-to-point fashion and/or through a network 163. For example, the network 163 may be provided by a router that is located close to one or more of the rooms 102, 104, 106. It may be advantageous to allow the user 132 to communicate with the local controllers 162 via the user device 128 and to control the devices of the load control system 100 in the rooms 102, 104, 106 from remote locations, such as via the network 163 or other public or private network. Similarly, it may be advantageous to allow third-party integrators to communicate with the local controllers 162 in order to control the devices in the rooms 102, 104, 106 and/or provide services to occupants of the rooms 102, 104, 106. Different occupants or users with a respective user device 128 may be assigned a user identifier or user type for the user device to communicate with a respective local controller 162. For example, a user may be assigned a user identifier or user type for communicating with a local controller 162 that is configured to control the load control devices in the room 102, 104, 106 to which the user has been checked in.

The local controllers 162 may be configured to communicate with a user device 128 via the network 163. The user device 128 may be a personal computing device, such as a laptop, a smart phone, and/or a tablet device. The user device 128 may be characterized by a unique identifier (e.g., a serial number or address stored in memory) that uniquely identifies the user device 128 and thus the user/occupant 132. The user device 128 may be configured to transmit messages to one or more local controllers 162, for example, in one or more messages transmitted via Internet Protocol packets and/or another wireless communication protocol (e.g., BLUETOOTH, etc.). The user device 128 may be configured to transmit messages over the network 163 to an external service, and then the messages may be received by one or more local controllers 162. The user device 128 may transmit and receive messages via RF signals 109 and/or a wired communication link. The RF signals 109 may be the same wireless frequency and/or transmitted using the same protocol as the RF signals 107. Alternatively, or additionally, the user device 128 may be configured to transmit RF signals 109 according to another signal type and/or protocol. The user device 128 may be configured to transmit messages via RF signals 107 and/or RF signals 109. The load control system 100 may comprise other types of computing devices coupled to the network 163, such as a desktop personal computer (PC), a wireless-communication-capable television, or any other suitable Internet-Protocol-enabled device. Examples of load control systems operable to communicate with mobile and/or computing devices on a network are described in greater detail in commonly-assigned U.S. Pat. No. 10,271,407, issued Apr. 23, 2019, entitled LOAD CONTROL DEVICE HAVING INTERNET CONNECTIVITY, the entire disclosure of which is hereby incorporated by reference.

The load control system 100 may be responsive to cloud services 164 that may be provided on one or more cloud servers 165 with which the local controllers 162 and/or the user device(s) 128 may be configured to communicate via the network 163, for example. For example, the cloud server(s) 165 operating the cloud services 164 may communicate with local controllers 162 and/or the user device(s) 128 via the network 163 and RF signals 109. The cloud services 164 may include or have access to one or more portions of the system configuration data generated by users of the cloud services 164 and stored in the cloud server(s) 165 from which the cloud services 164 are offered. For example, one or more portions of the system configuration data may be generated at the user device 128 or the local controllers 162 and may be transmitted to the cloud server(s) 165 on which the cloud services 164 are operating for enabling configuration and/or control of the load control system 100. Additionally, or alternatively, one or more portions of the system configuration data may be generated by users of the cloud services 164 and stored in the cloud server(s) 165 from which the cloud services 164 are offered and may be transmitted to the local controllers 162 and/or the user device 128 for performing configuration and/or control of the load control system 100. The cloud services 164 may be located on the cloud server(s) 165 that may be located remotely or locally with respect to the building in which the rooms 102, 104, 106 are located.

The operation of the load control system 100 may be programmed and configured using, for example, the user device 128 or other computing device (e.g., when the user device is a personal computing device). The user device 128 may provide the user with access to a control/configuration application (e.g., via a graphical user interface (GUI)) for allowing a user 132 to program how the load control system 100 will operate and/or be controlled. For example, the control/configuration application may be executed as a local application on the user device 128, or as a remote application or service (e.g., executing via the cloud services 164 on the cloud server(s) 165, the local controllers 162, and/or another remote computing device) that is accessed via a local application (e.g., a web browser or other local application enabling a web interface). The control/configuration application and/or the local controllers 162 (e.g., via instructions from the control/configuration application) may generate and/or store the system configuration data for enabling control of the devices in the load control system 100. The system configuration data may comprise a load control database that defines the operation of the load control system 100. Examples of configuration procedures for load control systems are described in greater detail in commonly-assigned U.S. Pat. No. 7,391,297, issued Jun. 24, 2008, entitled HANDHELD PROGRAMMER FOR A LIGHTING CONTROL SYSTEM; and U.S. Pat. No. 10,666,060, issued May 26, 2020, entitled COMMISSIONING LOAD CONTROL SYSTEMS, the entire disclosure of each of which is hereby incorporated by reference.

The user device 128 may be used by user 132 to update the system configuration data on which the load control system 100 operates. For example, the user 132 may request the system configuration data, or portions thereof, via the control/configuration application executing on the user device 128 for being displayed on the user device 128. The control/configuration application may request the system configuration data from one or more other devices in the load control system 100, such as one or more of the local controllers 162 and/or the cloud server(s) 165 on which the cloud services 164 are operating. Upon receiving the system configuration data requests from the control/configuration application on the user device 128, the local controllers 162 and/or the cloud services may respond by communicating the requested system configuration data to the user device 128. Though the user device 128 and/or the user 132 are provided as examples, other user devices and/or users may operate as described herein for the user device 128 and/or the user 132. For example, the user 132 may be a user, such as a resident or a guest, that may operate the user device 128 for controlling the electrical loads in the load control system 100. In another example, the user 132 may be a user capable of configuring the devices in the load control system 100.

The control/configuration application executing on the user device 128 may also allow the user device 128 to communicate messages to the local controllers 162 and/or the cloud services 164 to modify, edit, or change the system configuration data, such as a scene configuration stored therein, as further described herein. In one example, the user 132 may provide input on the user device 128 to schedule maintenance events for performing maintenance tasks to update the system configuration data with settings for controlling one or more control devices in a load control system. For example, the control/configuration application may cause the user device 128 to display a maintenance setup screen that allows the user to provide input for scheduling a maintenance event. The control/configuration application may be in communication with or include maintenance supervision software configured for performing and/or managing maintenance events on one or more devices in the load control system 100. The user may schedule a maintenance event by scheduling a maintenance task to be performed. The maintenance tasks may comprise test events to verify system performance (e.g., to verify performance or status of control devices, such as verifying the performance of emergency lighting fixtures), automatic recalibration procedures for updating operational settings of control devices (e.g., such as sensors), firmware updates, programming data updates for updating control settings to be uploaded into the system configuration data from which the load control devices may be controlled in the load control system.

The user may schedule a maintenance event by scheduling a test event to verify system performance, such as testing to verify the performance of emergency fixtures (e.g., testing of emergency fixtures using the Digital Addressable Lighting Interface (DALI) protocol) as a maintenance task via a maintenance setup screen for configuring the system configuration data. The user 132 may update lighting scenes for one or more rooms in a building, and the user device 128 may schedule (e.g., automatically schedule) a maintenance event to update the control settings that are stored at the lighting control devices that are a part of the lighting scenes for controlling one or more control devices in response to a triggering event. The changes to the lighting scenes may be uploaded for updating the system configuration data that is used to control the one or more control devices in the load control system.

The verification of system performance may be performed by a verification procedure performed at one or more local controllers 162 that verifies the responsiveness, functionality, and/or status of one or more control devices. For example, the verification procedure may be performed to query one or more control devices to identify whether the one or more control devices are responsive to messages. The verification procedure may be performed by querying one or more control devices to identify whether the one or more control devices have received messages from other control devices in the load control system 100. The verification procedure may be performed by querying one or more control devices to identify whether the one or more control devices are configured to perform a given function. The verification procedure may be performed by sending control instructions to one or more control devices to cause the one or more control devices to perform control of a corresponding electrical load and respond with an indication of whether the one or more control devices are configured to perform the control. The verification procedure may be performed by querying one or more control devices to determine a status (e.g., a battery status or a control level or state, such as an on/off state, an intensity level, a level of a covering material, a setpoint temperature, and/or another control level or state) of one or more control devices.

One example of verification of the system performance may be implemented for verifying the performance of lighting control devices installed in emergency lighting fixtures. The emergency lighting fixtures may be located in one or more rooms and/or common areas (e.g., hallways, stairwells, lobbies, and/or other common areas). One or more of the lighting control devices 108 may be installed in or connected to specific emergency lighting fixtures as additional lighting fixtures in areas of higher risk and/or common areas that may be occupied at any time of day (e.g., hallways, stairwells, lobbies, and/or other common areas). The verification procedure may be implemented by a triggering event, such as a predefined period of time scheduled for the verification procedure and/or one or more messages for triggering the verification procedure. For example, the one or more local controllers 162 may send a message to the lighting control devices 108 in the emergency lighting fixtures to initiate the verification procedure at the emergency lighting fixtures to verify the performance of the emergency lighting fixtures. The message may cause the lighting control devices 108 to turn the lighting loads on to a predefined intensity level and/or color and operate for at least a predefined period of time or until the battery is discharged (e.g., completely or to a predefined level). The verification procedure may be performed to test whether each of the lighting control devices 108 in an emergency lighting fixture can operate on the battery power for at least a predefined time period. At the end of the performance of the verification procedure at each of the emergency lighting fixtures, the lighting control devices 108 may each send results of the verification procedure to a local controller 162. The results may include an indication of whether the lighting control device 108 was able to operate for the predefined period of time and/or whether the battery discharged (e.g., completely or to a predefined level) before an expiration of the predefined period of time. The results may include an indication of whether the lighting control device 108 is still capable of operating on the battery power after the predefined period of time and/or an estimated amount of time for further operation based on the battery power. The results may include an indication of an amount of remaining battery power after the verification procedure. The results may include an indication of success or failure of the verification procedure based on one or more of the results described herein. The lighting control device 108 may cause the battery to be recharged after the verification procedure. The lighting control device 108 may be incapable of properly controlling the emergency lighting fixture during a period of being recharged (e.g., about 15 to 25 hours), which may make scheduling of the verification procedure difficult.

The recalibration procedure may be executed to adjust and/or update the operational settings of one or more devices (e.g., such as sensors). The recalibration procedure may be implemented by a triggering event at one or more local controllers 162, such as a predefined period of time scheduled for the firmware update procedure and/or one or more messages for triggering the recalibration procedure. For example, the one or more local controllers 162 may send a message to one or more control devices to initiate the recalibration procedure at the one or more control devices. The message may cause the one or more control devices to be inoperable for the duration of the recalibration procedure. The message may cause the control devices to recalibrate sensor input parameters or control parameters that may have changed over time. At the end of the performance of the recalibration procedure at each of the control devices, the control devices may each send feedback indicating the results of the recalibration procedure to a local controller 162. The results may include an indication of whether the recalibration procedure was successfully completed. The control devices, while being updated, may be inoperable, which may make scheduling of the recalibration procedure difficult.

The firmware updates may include updated features or security updates for one or more control devices. The firmware updates may be installed during a firmware update procedure, which may be implemented by a triggering event at one or more local controllers 162, such as a predefined period of time scheduled for the firmware update procedure and/or one or more messages for triggering the firmware update procedure. For example, the one or more local controllers 162 may send a message to one or more control devices to initiate the firmware update procedure at the one or more control devices to perform one or more firmware updates. The message may cause the one or more control devices to be inoperable for the duration of the firmware update procedure. The message may cause the control devices to control a respective electrical load during the firmware update procedure. At the end of the performance of the firmware update procedure at each of the control devices, the control devices may each send feedback indicating the results of the firmware update procedure to a local controller 162. The results may include an indication of whether the firmware updates were successfully installed and/or whether the control device is properly operating based on the firmware updates. The control devices that are being updated may be inoperable and/or automatically controlled to test control settings during the firmware updates, which may make a scheduling of the firmware update procedure difficult.

The programming updates may include updated control settings for controlling control devices in the load control system, such as updates to zone control settings for controlling electrical zones for collective control, updates to scenes for controlling one or more control devices in the load control system 100 in response to a triggering event, and/or other updates for controlling control devices in the load control system. The programming updates may be installed during a programming update procedure, which may be implemented by a triggering event at one or more local controllers 162, such as a predefined period of time scheduled for the programming update procedure and/or one or more messages for triggering the programming update procedure. For example, the one or more local controllers 162 may send a message to one or more control devices to initiate the programming update procedure at the one or more control devices to perform one or more programming updates. The message may cause the one or more control devices to be inoperable for the duration of the programming update procedure. The message may cause the control devices to control a respective electrical load during the programming update procedure. At the end of the performance of the programming update procedure at each of the control devices, the control devices may each send feedback indicating the results of the programming update procedure to a local controller 162. The results may include an indication of whether the programming updates were successfully installed and/or whether the control device is properly operating based on the programming updates. The control devices that are being updated may be inoperable and/or automatically controlled to test control settings during the programming updates, which may make scheduling of the programming update procedure difficult.

While the maintenance tasks are being performed, the load control devices of the load control system 100 may control the electrical loads in the rooms 102, 104, 106, which may be distracting or annoying to an occupant and/or may even cause the occupant to provide an input to an input device resulting in the interruption of the maintenance task. The maintenance tasks may also, or alternatively, cause load control devices in the rooms 102, 104, 106 in which the maintenance tasks are being performed to be unable to be controlled for their intended purposes by the occupants. As certain maintenance tasks may need to be performed at specific times (e.g., such as emergency maintenance tasks required by regulation or otherwise), maintenance tasks may be implemented as described herein for reducing problems that may be caused by the performance of the maintenance tasks in the presence of a user and/or when the user may be attempting to utilize the load control devices being maintained.

Each local controller 162 may include hardware and/or software configured as local services 171 that may be provided by the local controller 162. The local services 171 may be configured to communicate messages between control devices, generate control instructions configured to perform load control in response to triggering events, and/or perform maintenance tasks. The cloud services 164 may include the cloud services to support the local services 171 on the local controllers 162. For example, the cloud services 164 may store and/or update the system configuration data that may include the configuration/control for the load control system 100. The system configuration data stored at the cloud services 164 may include association information for associating devices, zone information for configuring zones of control devices for collective control, scene configurations or other control instructions for enabling control of one or more control devices, triggering events (e.g., time schedules, input events, etc.) that may operate to trigger control of one or more control devices, and/or other system configuration data. The cloud services 164 may support the scheduling and/or performance of maintenance tasks to be performed at the local controllers 162.

The local services 171 and/or the cloud services 164 may include hardware and/or software (e.g., as part of the control/configuration application for operating the load control system) that may enable the scheduling of maintenance tasks utilizing defined criteria. For example, the local services 171 on each local controller 162 may include hardware and/or software that may operate as a local maintenance supervisor that is configured to oversee the performance of the maintenance tasks for the control devices in each of the one or more rooms 102, 104, 106 for which the local services 171 are responsible. The cloud services 164 may include hardware and/or software that may operate as a cloud maintenance supervisor that is configured to oversee the maintenance tasks performed by each of the local maintenance supervisors. For example, the cloud maintenance supervisor of the cloud services 164 may provide the local maintenance supervisors of each of the local services 171 with information related to one or more maintenance tasks to be scheduled and/or instruct the local maintenance supervisors regarding when to perform the maintenance tasks. The user 132 may provide input to the cloud maintenance supervisor via the user device 128 to identify and/or queue maintenance tasks to be provided and/or appropriate criteria for when the maintenance tasks may be performed. The input may be communicated via software operating on the user device 128, such as via the control/communication application, for example. The input may be provided to the cloud maintenance supervisor via a local maintenance supervisor operating on the local services 171 on one or more of the local controllers 162.

FIGS. 2A-2D are example flowcharts that illustrate one or more example procedures that may be performed for enabling and executing maintenance tasks to be performed on one or more control devices in a load control system. The procedures of FIGS. 2A-2D may be performed by a maintenance supervision software that may be executed by one or more devices. For example, the maintenance supervision software may be distributed across one or more cloud servers operating cloud services (e.g., the one or more cloud servers 165 operating the cloud services 164) and one or more local controllers (e.g., the one or more local controllers 162 operating the local services 171). As described herein, the maintenance supervision software may be executed by the control circuit of one or more computing devices for performing one or more portions of the procedures. For example, the maintenance supervision software may be configured to operate as a cloud maintenance supervisor executing on the cloud server and/or a local maintenance supervisor executing on a local controller.

Figure 2A:
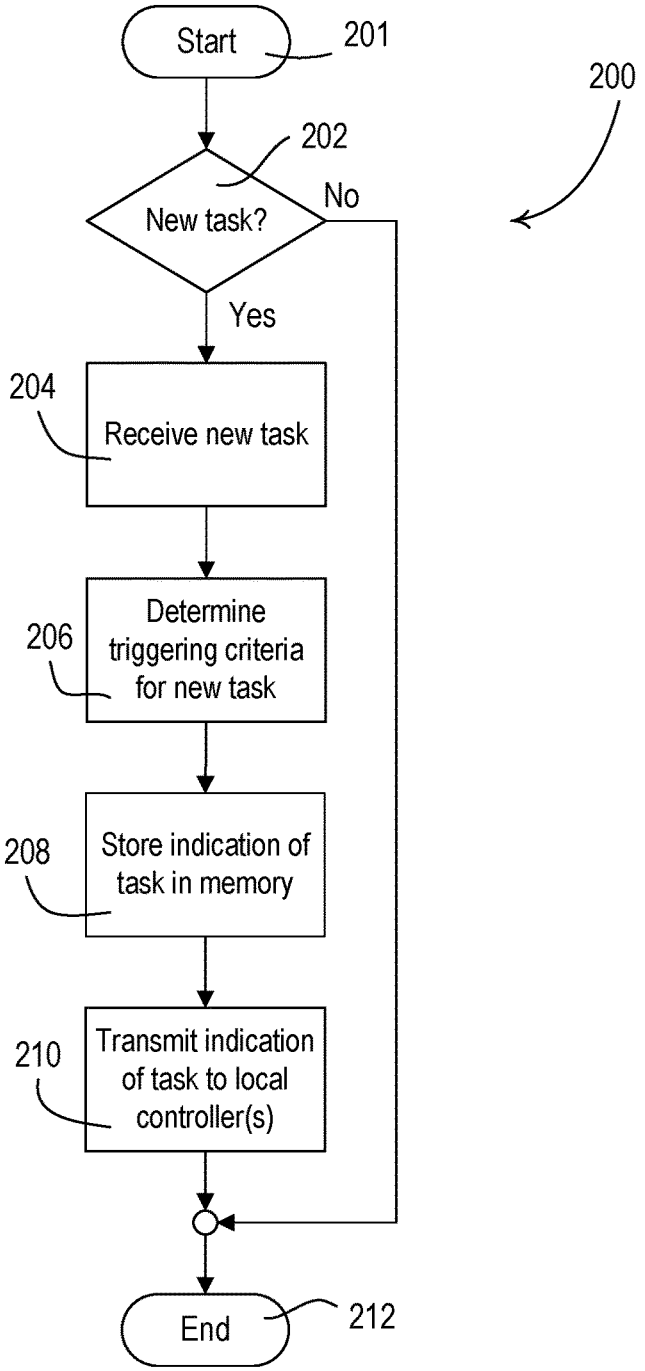
FIGS. 2A-2D are flow diagrams of example procedures that may be performed for enabling maintenance tasks to be performed on one or more devices in a load control system.

FIG. 2A is a flowchart of an example procedure 200 that may be performed for enabling maintenance tasks to be performed on one or more control devices in a load control system. For example, the procedure 200 may be executed by one or more control circuits on one or more cloud servers (e.g., operating the one or more cloud services 165) operating the cloud maintenance supervisor. The cloud maintenance supervisor may start the procedure 200 at 201, for example, periodically. In addition, or alternatively, the cloud maintenance supervisor may start the procedure 200 at 201 in response to a trigger event, such as receiving one or more messages. For example, the message may include an indication to schedule one or more maintenance events for performing one or more maintenance tasks. A maintenance event may include one or more maintenance tasks and/or the corresponding triggering criteria for performance of the one or more maintenance tasks. Thus, the maintenance event may be scheduled in response to a scheduling of one or more maintenance tasks. The maintenance tasks may be performed to test system performance, recalibrate control devices, update firmware on control devices, and/or update the system configuration data with control settings for controlling one or more control devices in a load control system. The message(s) including the indication may be transmitted to the cloud server in response to user input to schedule a maintenance event. For example, the cloud maintenance supervisor executed on the cloud server(s) may receive the message(s) including the indication to schedule maintenance events for performing maintenance tasks at 201.

At 202, the cloud maintenance supervisor on the cloud server may determine if a received message (e.g., as received at 201) includes an indication of a new maintenance task to be scheduled that is not already scheduled. If not, the procedure 200 may end at 212. If the received message includes an indication of a new maintenance task to be scheduled at 202, the cloud maintenance supervisor may receive the new maintenance task to be scheduled at 204. For example, the maintenance task may be scheduled for enabling performance of one or more maintenance tasks on one or more control devices in the load control system. The maintenance task may be scheduled by a user or automatically. In an example, the user may access a maintenance setup screen via the user device to schedule maintenance tasks to be performed on one or more control devices in the load control system. In another example, maintenance tasks may be automatically scheduled by one or more computing devices, such as the cloud servers and/or the local controllers. The maintenance task may include tests for verifying system performance, recalibration procedures, firmware updates, programming data updates, or other maintenance tasks to be performed in the load control system.

Each maintenance task may include instructions for determining when to perform the corresponding maintenance task. The instructions may be generated based on one or more selections by the user. The instructions for determining when to perform the corresponding maintenance tasks may depend upon the specific maintenance task (e.g., firmware updates, programming data updates, testing procedures to verify system performance, instructions for performing a recalibration procedure, and/or other updates to the system configuration data that may be used to control the load control devices in the load control system). Different times of day, week, month, year and/or frequency of the maintenance task may be scheduled for different types of maintenance tasks. For example, a verification procedure may be performed once a year or a predefined number of times a year (e.g., each month or quarter) for testing to verify the performance of emergency fixtures (e.g., testing of emergency fixtures using the Digital Addressable Lighting Interface (DALI) protocol), while a firmware update procedure may be performed with greater frequency and/or irregularly based on times at which an update to the firmware is uploaded to the cloud server.

At 206, the cloud maintenance supervisor on the cloud server may determine triggering criteria for performance of the new task (e.g., received at 204). Each received maintenance task may be characterized with corresponding triggering criteria for performing the maintenance task. The triggering criteria may include one or more criteria for triggering the corresponding maintenance task of a maintenance event. The triggering criteria may be based on the instructions of each maintenance task (e.g., received from the user input). For example, the maintenance tasks may include a first maintenance task that is scheduled to be performed quarterly or within another predefined interval and the triggering criteria may be set to predefined times based on the instructions. The triggering criteria may include one or more rules for triggering the performance of the maintenance task. The rules of the triggering criteria may be generated based on one or more selections by the user. The rules of the triggering criteria may be generated automatically based on selection of the task. The rules may be defined by one or more parameters including a checked-in status, an occupancy status, a time of day, a period of time since last occupancy, a period of time since a change in the checked-in status, a period of time since last performance of the maintenance task, an indication of an override, a daylight intensity value, a temperature of a room, a temperature outside of the room/building, a lighting intensity value, a status of a load control device, a status of an electrical load, a status of an occupant, a control device or device type, and/or another parameter. The checked-in status may include a status of a room being checked in or checked out (e.g., hotel room being sold/checked in or unsold/checked out, an office being scheduled for a meeting or unscheduled, etc.). The period of time since the change in the checked-in status may include a period of time since a room has been checked out. The occupancy status may be indicated by an occupancy condition or vacancy condition (e.g., received from an occupancy sensor in the space and/or derived from one or more other parameters, such as an access point, such as a door card reader, being activated by an access key, an opening of a door, an input from one or more sensors, a user activity in a room, indications from touchscreens and apps in the room, and/or other parameters). The status of the load control device or electrical load may be an on/off status, a level, or other indication of status. The status of the occupant may indicate the status of a guest, an owner or other person with a status configured to perform system configuration. Based on the status of certain occupants (e.g., owner or other person with a status capable of performing system configuration), the maintenance task may be performed even though the space is occupied or scheduled to be occupied. The control device or device type may indicate individual devices or types of devices by an identifier to trigger updates to individual devices or device types.

In one example, the maintenance event may include triggering criteria for scheduling other programming tasks, such as updates to programming data or firmware. The triggering criteria may include multiple rules for updating the programming data or firmware of the control devices in one or more rooms of the load control system. For example, the triggering criteria may cause the programming data or firmware of the control devices to be updated in response to or within a predefined period of time of receipt of updates to the programming data or firmware. For example, updates may be performed to the programming data by the user, such as updates to control settings configured for a given scene or other control settings for controlling control devices. Programming updates and/or firmware updates may be received at the cloud server and/or the local controller and the triggering criteria may define the rules for performing the updates at the control devices in response to the receipt of a message or within a predefined period of time. The triggering criteria may include a rule to perform the update to firmware or the programming data when a room is vacant and/or checked out. In another example, the triggering criteria may include a rule that when the room is checked out and has been checked out or vacant for a predefined period of time for the update to the firmware or the programming data to be performed. This may allow for a period of time during which an occupant may return to the room after leaving before performing the update to the firmware or the programming data. In another example, the triggering criteria may include a rule that the update be performed when the room is checked out, and the room is scheduled to be occupied on a certain date, and the next occupant is scheduled to be an owner or other person with a status capable of performing system configuration. The triggering criteria may include a time of day (e.g., a time at which the maintenance task is triggered or a period of time in which maintenance task is to be performed/completed). For example, the time of day may be set to a time of day when a room is less likely to be occupied or when changes in status of electrical loads may be less likely to be noticed by occupants (e.g., 2 AM in conference room or a checked-out hotel room, etc.). The time of day may be set to a time of day when the control devices are less likely to be controlled. For example, updates may be performed on the lighting control devices during daylight hours when the lighting devices are less likely to be controlled or turned on. The time of day may be a time of day when occupants are likely to be absent or less occupants are likely to be present, such as during predefined nighttime hours (e.g., 11:30 PM to 4:30 AM). The time of day may be a time of day (e.g., 9 AM to 5 PM) when people outside of the building would be less likely to notice the operation of control devices (e.g., flickering of lights or movement of shades) within the building.

In another example, the maintenance event may include a maintenance task for testing events to verify system performance (e.g., testing to verify the performance of emergency lighting fixtures) and may include triggering criteria for scheduling the testing events. A testing event may be executed to verify system performance by performing a verification procedure. The verification procedure may be required to be performed at certain times of day and/or within a certain number of days of prior tests. The triggering criteria may include a rule to cause the verification procedure to be performed after the update to firmware or the programming data. The triggering criteria may include a rule to cause the recalibration procedure to be performed when an update is received for operating within different predefined parameters (e.g., update to system configuration data). The triggering criteria may include a rule that a room is checked out, that the number of days since the last test for verifying system performance is greater than a predefined number of days, and/or the time of day is within a predefined timeframe. The triggering criteria may also include a rule that a room is checked out, that the number of days since the last test to verify the system performance is greater than a predefined number of days, and/or that there is at least a predefined period of time until a room is checked in. The rules may each be implemented, such that each rule may be used to trigger the performance of the maintenance task in the alternative of the triggering criteria in the other rules failing to be met. The triggering criteria may further include a rule that allows for an override to perform the maintenance task in the event the other triggering criteria fail to be met. For example, the triggering criteria may include a rule that the room is checked out and an indication of an override is received (e.g., via an owner or other person with a status capable of performing system configuration). The indication of the override may indicate that an override message may be received from a user and override the fact that other triggering criteria may fail to be met and cause the maintenance task to be performed in the absence of those other triggering criteria being met. The triggering criteria for the verification procedure may include a time of day (e.g., a time at which maintenance task is triggered or a period of time in which maintenance task is to be performed/completed). The time of day may be a time of day when occupants are likely to be absent or less occupants are likely to be present, such as during predefined nighttime hours (e.g., 11:30 PM to 4:30 AM). The time of day may be a time of day (e.g., 9 AM to 5 PM) when people outside of the building would be less likely to notice the operation of control devices (e.g., flickering of lights or movement of shades) within the building.

In another example, the maintenance event may include maintenance task that includes a recalibration procedure and may include triggering criteria for scheduling the recalibration procedure. The recalibration procedure may be executed to adjust and/or update the operational settings of one or more devices (e.g., such as sensors). The triggering criteria may include a rule to cause the recalibration procedure to be performed when one or more control devices are operating outside of predefined parameters. The triggering criteria may include a rule to cause the recalibration procedure to be performed when an update is received for operating within different predefined parameters (e.g., update to system configuration data). The triggering criteria may include a rule that a room is checked out, that the number of days since the last recalibration procedure is greater than a predefined number of days, and/or the time of day is within a predefined timeframe. The triggering criteria for the recalibration procedure may include a time of day (e.g., a time at which maintenance task is triggered or a period of time in which maintenance task is to be performed/completed). The time of day may be a time of day when occupants are likely to be absent or less occupants are likely to be present, such as during predefined nighttime hours (e.g., 11:30 PM to 4:30 AM). The time of day may be a time of day (e.g., 9 AM to 5 PM) when people outside of the building would be less likely to notice the operation of control devices (e.g., flickering of lights or movement of shades) within the building.

The triggering criteria for each new maintenance task for performing the maintenance task may include a priority level that indicates a priority of the tasks when there is a conflict of maintenance tasks to be performed at the same time or overlapping times if a task takes a prolonged period of time. For example, the triggering criteria may indicate a level of priority for different types of maintenance tasks. The recalibration and/or verification procedures may be given priority over programming updates or firmware updates, as the recalibration and/or verification procedures may be performed less frequently. The priority may also, however, be configured in any manner and/or user configured. The priority of a given maintenance task may change based on a time of day or other triggering criteria for a given maintenance task. For example, a maintenance task may be given a higher priority when it has a larger number of triggering criteria to be met or more strict triggering criteria to be met causing the task to be performed less often. In one example, a maintenance task that is scheduled to be performed less frequently (e.g., once a year) and having other triggering criteria, such as a checked-in status or an occupancy status that requires a space to be checked-out or unoccupied for a relatively longer period of time than the triggering criteria for other maintenance tasks, may be given a higher priority than the other maintenance tasks. Certain maintenance tasks may be given priority during predefined times of day, month, or year. For example, certain maintenance tasks, such as the verification procedure or programming updates, that may cause control devices to be inoperable (e.g., for longer periods of time) or that may cause a change in the electrical loads in the space by the control devices may be given a higher priority during predefined nighttime hours (e.g., 11:30 PM to 4:30 AM) when a building is likely to be less occupied or unoccupied. In another example, certain maintenance tasks, such as performance of firmware updates (e.g., which may take two to five minutes), that may allow control devices to be operable (e.g., or inoperable for shorter periods of time) or that do not cause a change in the electrical loads in the space by the control devices may be given a higher priority during predefined daytime hours (e.g., 8:00 AM to 6:00 PM) when a building is more likely to occupied.

If an indication of an override is received (e.g., via a user input on a user device or other input device in the load control system) for a given maintenance task, the maintenance task may be given a higher priority than other maintenance tasks for which an indication of an override is not received. If an indication of an override is received for multiple maintenance tasks that have been scheduled, the maintenance tasks may be given priority on a first-in-first-out basis or may be prioritized based on other triggering criteria, as described herein.

Individual control devices or types of control devices may be prioritized in the triggering criteria for the maintenance task to be performed on certain control devices or types of control devices over others. For example, when performing a maintenance task that may cause certain control devices to be inoperable, the triggering criteria may include control devices or types of control devices on which the maintenance task is to be performed over other control devices or types of control devices with a lower priority. This may prevent each of the control devices from being inoperable at the same time. In another example, where the maintenance task may cause control devices to perform communications via RF messages, the prioritization of certain control devices or types of control devices over others may prevent control devices from all transmitting RF messages at the same time to increase the chances of successful communications (e.g., preventing collisions of messages) communicating on the same RF communication protocol and/or channel.

At 208, the cloud maintenance supervisor on the cloud server may store the maintenance tasks and/or the corresponding triggering criteria for the new maintenance event in memory (e.g., in the system configuration data). For example, the maintenance tasks and/or the corresponding triggering criteria may be stored, at 208, in memory at one or more cloud servers capable of offering cloud services via the maintenance supervision software. The maintenance tasks and/or the corresponding triggering criteria may be accessible by the cloud maintenance supervisor. The cloud maintenance supervisor may be executed as a portion of the maintenance supervision software used to configure and/or control the execution of maintenance tasks of the load control devices in the load control system. The cloud maintenance supervisor may coordinate tasks across various local controllers in the load control system by sending an indication of maintenance tasks and/or triggering criteria (e.g., in scheduled maintenance events) to the local maintenance supervisors on the local controllers.

At 210, the cloud maintenance supervisor on the cloud server may transmit an indication of the maintenance task and/or the corresponding triggering criteria to one or more local controllers. For example, the cloud maintenance supervisor may transmit the indications of the maintenance tasks and/or the corresponding triggering criteria in one or more messages to the local controllers via a network (e.g., the network 163). In one example, the cloud maintenance supervisor may identify the maintenance tasks and/or the corresponding triggering criteria to be transmitted to different local controllers based on the load control devices in the room, load control device types, room type, and/or other characteristics.

The cloud maintenance supervisor on the cloud server may transmit an indication of the maintenance task and/or the corresponding triggering criteria to the one or more local controllers to allow the local controllers to manage the maintenance tasks locally. For example, the indication of the maintenance tasks and/or the corresponding triggering criteria may be provided to each of the local controllers to allow the local maintenance supervisors on each of the local controllers to manage the triggering criteria for performance of each of the maintenance tasks locally. The maintenance tasks of the control devices that are operating under the control of or that are in communication with a local controller may be managed by the local maintenance supervisor operating on the local controller, as described herein. In other words, the cloud maintenance supervisor may communicate with local maintenance supervisors to communicate maintenance tasks and triggering criteria. The local maintenance supervisors may then oversee the performance of the tasks based on the triggering criteria.

When the cloud server transmits the indication of the maintenance task and/or the corresponding triggering criteria to multiple local controllers, individual local controllers may be prioritized or offset in time. The cloud maintenance supervisor on the cloud server may introduce a priority level or timing offset to certain local controllers for performing the maintenance tasks. This may prevent each of the control devices in the load control system 100 from being inoperable at the same time. In another example, where the maintenance task may cause control devices to perform communications via RF messages, the prioritization or timing offset for performing maintenance tasks at different local controllers may prevent control devices and/or local controllers from all transmitting RF messages at the same time to increase the chances of successful communications (e.g., preventing collisions of messages) communicating on the same RF communication protocol and/or channel. The prioritized local controllers may be triggered for performing a maintenance task and lower priority control devices may be given approval by the cloud maintenance supervisor on the cloud server or may identify a completion of the prioritized local controllers of a maintenance task when the local controllers report feedback of the results of the maintenance task. For programming or firmware updates, the updates may be performed by each local controller and/or control devices for each local controller collectively to ensure compatibility between control devices and/or local controllers within the load control system. The procedure 200 may end at 212.

Figure 2B:
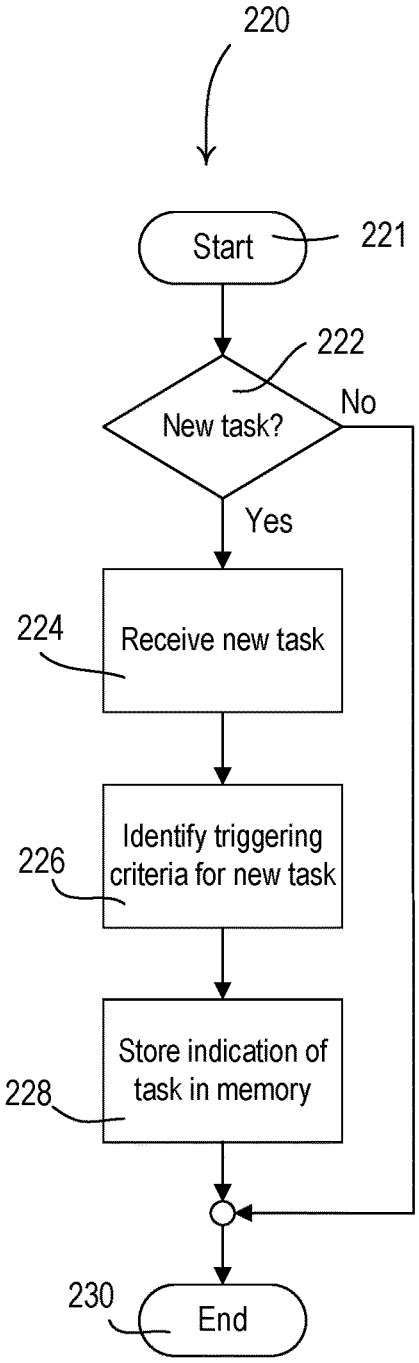

FIG. 2B is a flowchart of an example procedure 220 that may be performed for enabling maintenance tasks to be performed on one or more devices in a load control system. For example, the procedure 220 may be executed by one or more control circuits on one or more of the local controllers (e.g., the local controllers 162) that is operating one of the instances of the local maintenance supervisor. The local maintenance supervisor may start the procedure 220 at 221, for example, periodically. In addition the local maintenance supervisor may start the procedure 220 at 221 in response to a message. For example, the message may include an indication of a maintenance event for performing a maintenance task. For example, the maintenance tasks may be performed to test system performance, recalibrate control devices, update firmware on control devices, and/or update the system configuration data with control settings for controlling one or more control devices in a load control system. The message including the indication may be transmitted in response to a user input to schedule a maintenance event. For example, the local maintenance supervisor executed on one of the local controllers may receive the message including the indication of the maintenance event for performing the maintenance task at 221.

At 222, the local maintenance supervisor on the local controller may determine if a received message (e.g., as received at 221) includes an indication of a new maintenance event to be scheduled. If not, the procedure 220 may end at 230. If the received message includes an indication of a new maintenance event to be schedules at 222, the local maintenance supervisor may receive the maintenance task and/or the corresponding triggering criteria at 224. For example, each local controller may operate a local maintenance supervisor for supervising the performance of maintenance tasks by one or more load control devices in the load control system. The maintenance tasks and/or the corresponding triggering criteria may be received, at 224, by the local maintenance supervisor. Each local maintenance supervisor may be executed as a portion of the maintenance supervision software used to configure and/or control the execution of maintenance tasks of the load control devices in the load control system. Each local maintenance supervisor may supervise the performance of maintenance tasks for the load control devices in one or more rooms. Each of the local maintenance supervisors operating on the local controllers may store the maintenance tasks and/or the corresponding triggering criteria for determining when to perform the maintenance tasks on load control devices in one or more rooms.

At 226, the local maintenance supervisor on the local controller may identify the triggering criteria for each of the maintenance tasks that may be performed in order to determine whether the triggering criteria have been met. The triggering criteria for each maintenance task may include a priority level that indicates a priority of the tasks when there is a conflict of tasks to be performed at the same time or overlapping in time. As described herein, the priority level may be received with the corresponding triggering criteria at 224. In another example, the priority level of maintenance tasks may be predefined at the local controller. The priority levels may be similarly assigned to maintenance tasks and/or control devices, as described herein. For example, the priority of a given maintenance task may be based on a frequency of the maintenance task, a time period (e.g., a time of day, a time of month, a time of year), a number of triggering criteria, whether the maintenance task will cause control devices to be inoperable or inoperable for a period of time, and/or other triggering criteria for a given maintenance task. If an indication of an override is received or has been determined to be received for a given maintenance task, the maintenance task may be given a higher priority than other maintenance tasks for which an indication of an override is not received. Individual control devices or types of control devices may be prioritized in the triggering criteria for the maintenance task to be performed on certain control devices or device types over others, as described herein.

At 228, the local maintenance supervisor on the local controller may store the maintenance tasks and/or the corresponding triggering criteria for the new maintenance task in memory (e.g., in the system configuration data). For example, the maintenance tasks and/or the corresponding triggering criteria may be stored, at 228, in memory at local controller via the maintenance supervision software. The maintenance tasks and/or the corresponding triggering criteria may be accessible by the local maintenance supervisor. The local maintenance supervisor may be executed as a portion of the maintenance supervision software used to configure and/or control the execution of maintenance tasks of the load control devices in the load control system. The procedure 220 may end at 230.

Figure 2C:
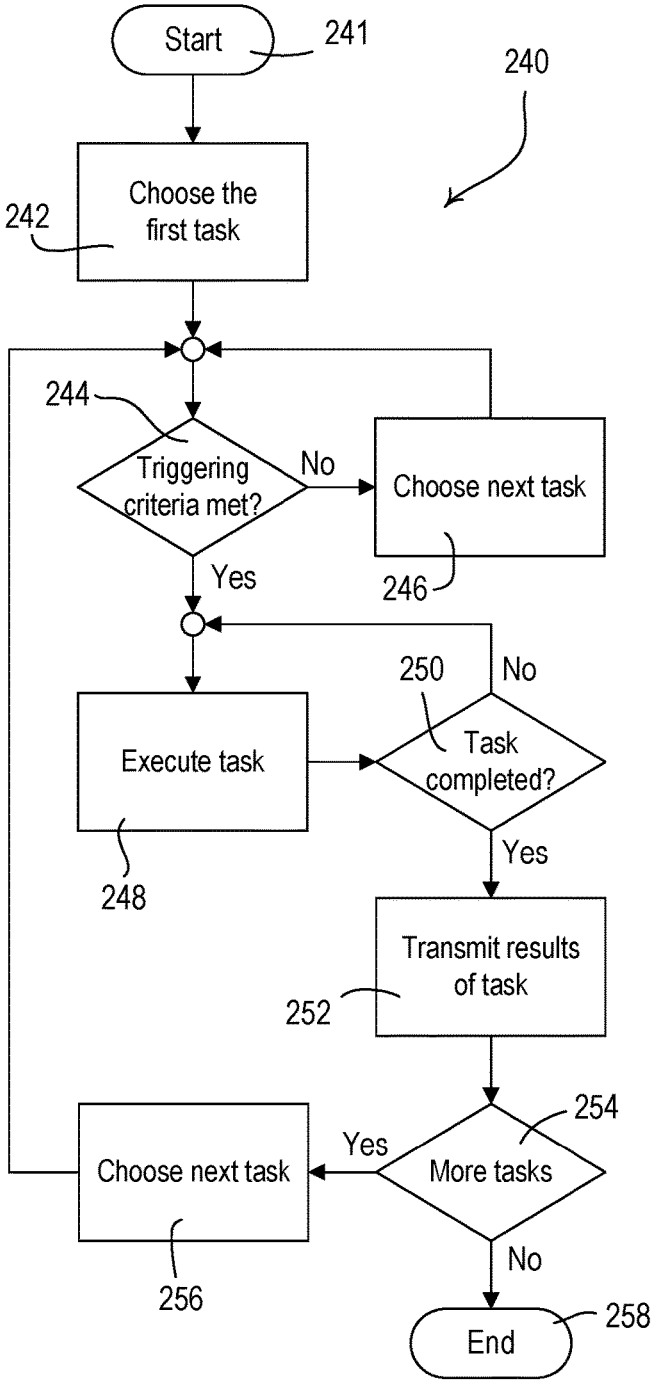

FIG. 2C is a flowchart of an example procedure 240 that may be performed for executing maintenance tasks on one or more devices in a load control system. For example, the procedure 240 may be executed by one or more control circuits on one or more of the local controllers (e.g., the local controllers 162) that is operating an instance of the local maintenance supervisor. The local maintenance supervisor may start the procedure 240 at 241 when the local processor has a maintenance task to execute. In some examples, the local maintenance supervisor may start the procedure 240 at 241, for example, periodically. For example, the maintenance tasks may be performed to test system performance, recalibrate control devices, update firmware on control devices, and/or update the system configuration data with control settings for controlling one or more control devices in a load control system. For example, the local maintenance supervisor running on one of the local controllers may execute the procedure 240 at 241.

The local maintenance supervisor on the local controller may select a first (e.g., an initial) maintenance task at 242. For example, the first maintenance task may be a first maintenance task stored in memory at the local controller (e.g., in a list of tasks). At 244, the local maintenance supervisor on the local controller may determine whether the triggering criteria corresponding to the selected maintenance task has been met. If the triggering criteria are not met for performing the maintenance task at 244, the local maintenance supervisor on the local controller may select a next maintenance task (e.g., in a list of tasks) at 246 and determine, at 244, whether the triggering criteria corresponding to the selected maintenance task has been met. Each maintenance task may have triggering criteria that include one or more separate rules (e.g., alternative rules) that may be defined for triggering the performance of the maintenance task. When the triggering criteria for multiple maintenance tasks have been met, the maintenance tasks may each be queued and performed on a first-in-first-out basis, or may be prioritized, as described herein.

If, at 244, the local maintenance supervisor on the local controller determines that the triggering criteria have been met for one or more of the defined rules for triggering a maintenance task, the local maintenance supervisor may cause the maintenance task to be executed at 248. For example, the local maintenance supervisor may cause the local controller to transmit commands to one or more load control devices for configuring and/or controlling the load control devices. The local controller may receive feedback messages from load control devices that include results of the maintenance task that has been performed. For example, the results may include measurements and/or acknowledgements from the load control devices that have performed the maintenance task. The results may include a time at which the maintenance task completed at each of the load control devices. The results may include a pass/fail indication of a result of a test performed on the one or more control devices. The results of a programming or firmware update may indicate whether one or more control devices are properly operating based on the updates. The local maintenance supervisor on the local controller may execute the task until the task is completed at 250.

When the task is complete at 250, the local maintenance supervisor on the local controller may transmit results of the maintenance task to the cloud maintenance supervisor. The local maintenance supervisor on the local controller may transmit the results of the maintenance task after completion (e.g., immediately after completion) of the task or at a predefined time. In some examples, the local maintenance supervisor on the local controller may transmit the results of multiple maintenance tasks at a predefined time. For example, the local maintenance supervisor on the local controller may store the results of one or more maintenance tasks until receiving a request from the cloud maintenance supervisor, for example, to report the results of the maintenance tasks to the cloud maintenance supervisor. The local maintenance supervisor on the local controller may transmit the results of multiple maintenance tasks in a message together with an identifier of each of the maintenance tasks performed and the corresponding results based on responses from the load control devices being maintained by the local maintenance supervisor.

If there are more maintenance tasks to be completed at 254, the local maintenance supervisor on the local controller may select the next maintenance task at 256. For example, the next maintenance task may be the next maintenance task stored in memory at the local controller (e.g., in a queue or list of tasks). The next maintenance task may be selected based on a priority of the maintenance tasks, as described herein. The local maintenance supervisor on the local controller may then determine whether the triggering criteria corresponding to the selected maintenance task has been met at 244, and, if so, cause the maintenance task to be executed at 248. When there are no more maintenance tasks to be completed at 246 or 254, the procedure 240 may end at 258.

Figure 2D:
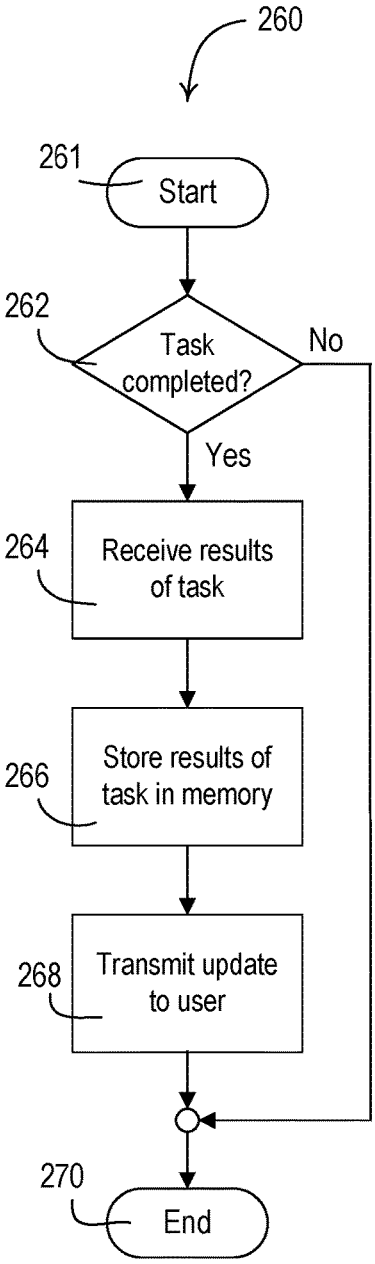

FIG. 2D is a flowchart of an example procedure 260 that may be performed for reporting results of maintenance tasks performed on one or more devices in a load control system. For example, the procedure 260 may be executed by a control circuit on one or more cloud servers (e.g., the one or more cloud services 165) that is operating the cloud maintenance supervisor. The cloud maintenance supervisor may start the procedure 260 at 261, for example, periodically. In some examples, the cloud maintenance supervisor may start the procedure 260 at 261 in response to receiving a message (e.g., from local controller). For example, the message may include results of a maintenance task. The cloud maintenance supervisor on the cloud server may coordinate reporting of results of one or more maintenance tasks from each local controller after the local maintenance supervisor on the local controller has completed the one or more maintenance tasks. The message including the results of the maintenance task(s) may be received from the local controllers in response to execution of the maintenance event at the local controllers. For example, the cloud maintenance supervisor executed on the cloud server(s) may receive the message(s) including the results of the maintenance tasks at 261. Each local maintenance supervisor may transmit one or more messages indicating completion of one or more maintenance tasks to the cloud maintenance supervisor. For example, the message indicating completion of the maintenance task may include the results of the maintenance task. In some examples, the message indicating completion of the maintenance task may not include the results of the maintenance task. After receiving a message that includes an indication that a local maintenance supervisor has completed a maintenance task, but does not include the results of the maintenance task, the cloud maintenance supervisor on the cloud server may transmit a message to a user device indicating the local maintenance supervisor of the local controller is to report the results of the maintenance task.

At 262, the cloud maintenance supervisor on the cloud server may determine whether a received message (e.g., as received at 261) includes an indication that a maintenance task has been completed for one of the local controllers (e.g., one of the local maintenance supervisors that was to perform a scheduled maintenance task). If not, the procedure 260 may end at 270. If the message includes an indication that a maintenance task has been completed for one of the local controllers (e.g., one of the local maintenance supervisor that was to perform the scheduled maintenance tasks), the cloud maintenance supervisor of the cloud server may receive the results of the maintenance task at 264 and store the results of the maintenance task in memory (e.g., in the system configuration data) at 266. For example, the results of the maintenance tasks may be stored, at 266, in memory at one or more cloud servers configured to offer cloud services via the maintenance supervision software. The results of the maintenance tasks may be accessible by a cloud maintenance supervisor. At 268, the cloud maintenance supervisor on the cloud server may transmit a message including an update to a user on a user device. The update may be presented on the maintenance setup screen or other user interface provided by the control/configuration application. The update may include the results of the maintenance task. The message including the update may be sent via an email or another notification to a user.

The procedures 220, 240 of FIGS. 2B and 2C may be performed by multiple local maintenance supervisors running at multiple local controllers (e.g., for different rooms or other defined spaces). Because each local controller is determining when to execute the maintenance tasks, the maintenance tasks may be performed at different times, such as when one room is occupied and one room is vacant, for example. Each local maintenance supervisor on a local controller may determine an occupancy state by looking at data from an occupancy sensor.

Figure 3:
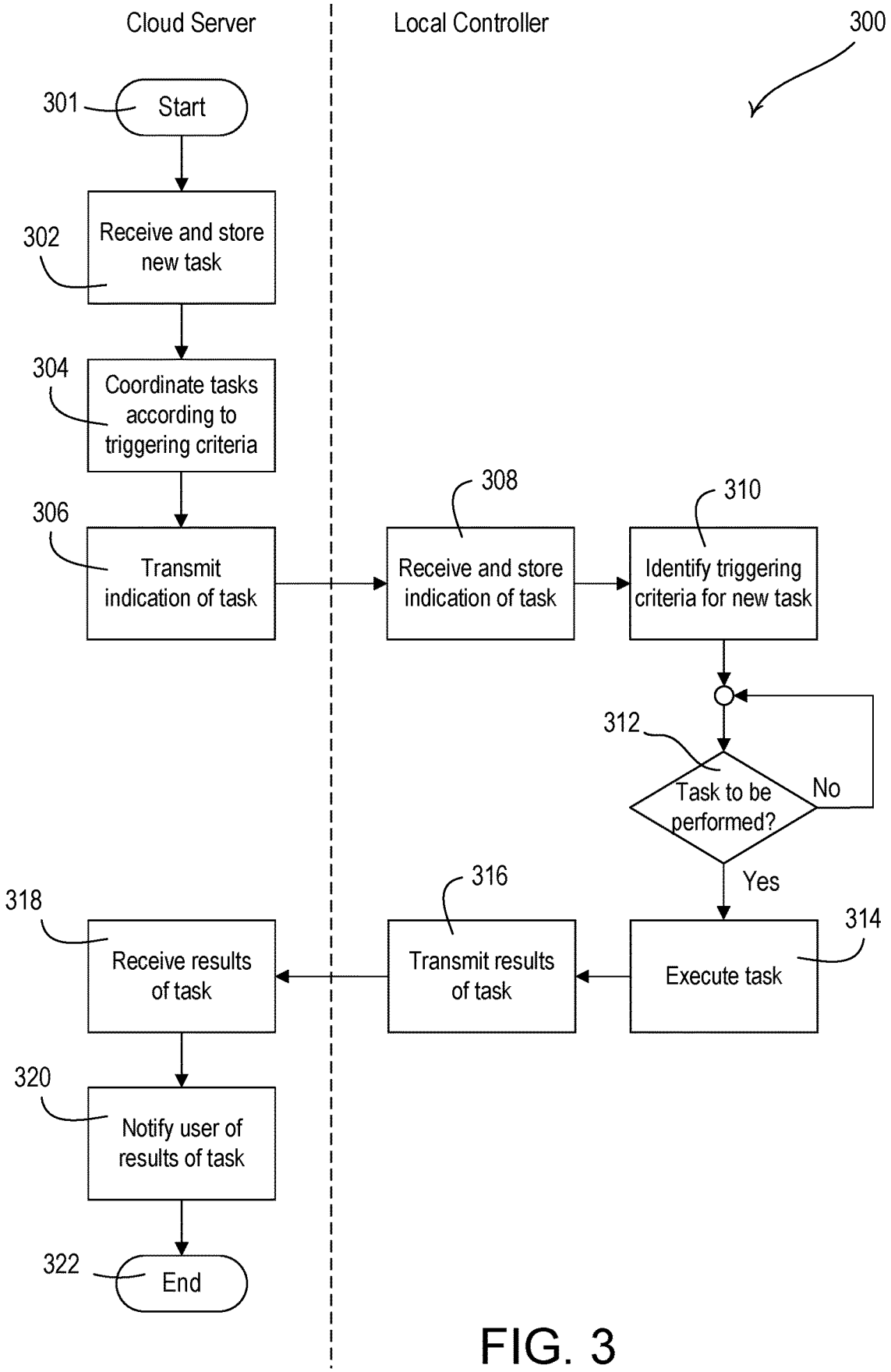
FIG. 3 is a flow diagram of an example procedure that may be performed for executing maintenance tasks on one or more control devices in a load control system.

FIG. 3 is a flow diagram of an example procedure 300 that may be performed for applying maintenance tasks on one or more control devices in a load control system. The procedure 300 may be performed by maintenance supervision software that may be executed by one or more control circuits on one or more devices. For example, one or more portions of the procedure 300 may be performed by one or more control circuits operating the maintenance supervision software, which may be distributed across a cloud server operating cloud services and one or more local controllers operating local services. As described herein, the maintenance supervision software may be executed by the control circuit of one or more computing devices for performing one or more portions of the procedure 300. For example, the maintenance supervision software may be configured to operate a cloud maintenance supervisor executing on the cloud server and/or a local maintenance supervisor executing on a local controller.

As shown in FIG. 3, the procedure 300 may begin at 301. At 302, the cloud maintenance supervisor on the cloud server may receive and store a new maintenance task. The maintenance task may be received via a maintenance event comprising one or more triggering criteria that characterize the maintenance task. At 304, the cloud maintenance supervisor on the cloud server may coordinate the maintenance tasks according to triggering criteria. For example, the cloud maintenance supervisor on the cloud server may coordinate the maintenance tasks to be performed across various local controllers according to corresponding triggering criteria. The cloud maintenance supervisor on the cloud server may determine the triggering criteria for the maintenance tasks (e.g., received at 302). Each received maintenance task may be characterized with corresponding triggering criteria for performing the maintenance task. The triggering criteria may include one or more criteria for triggering the corresponding maintenance task, as described herein.

At 306, the control circuit (e.g., operating the cloud maintenance supervisor) on the cloud server may transmit an indication of the maintenance task and/or the corresponding triggering criteria to one or more local controllers. For example, the control circuit of the cloud server may transmit the indications of the maintenance tasks and/or the corresponding triggering criteria in one or more messages to the local controllers via a network. In one example, the control circuit may identify the maintenance tasks and/or the corresponding triggering criteria to be transmitted to different local controllers based on the load control devices in various rooms, load control device types, room type, and/or other characteristics. The cloud server may transmit an indication of the maintenance task and/or the corresponding triggering criteria to the one or more local controllers to allow the local controllers to manage the maintenance tasks locally.

At 308, the local maintenance supervisor on a local controller may receive the maintenance task and/or the corresponding triggering criteria. For example, each local controller may operate a local maintenance supervisor for supervising the performance of maintenance tasks by one or more load control devices in the load control system. At 310, the local maintenance supervisor on the local controller may identify the triggering criteria for each of the maintenance tasks that may be performed in order to determine whether the triggering criteria have been met. The triggering criteria may be determined from the message that includes the indication of the task that is received at 308. In another example, the triggering criteria may be predefined at the local controller for a given type of maintenance task. The local maintenance supervisor on the local controller may iterate through the triggering criteria for each of the maintenance tasks (e.g., in a first-in-first-out queue). The triggering criteria for each maintenance task may include a priority level that indicates a priority of the tasks when there is a conflict of tasks to be performed at the same time and determine, at 312, whether the maintenance task is to be performed. If the triggering criteria are not met for the maintenance task, the local maintenance supervisor on the local controller may iterate to the next maintenance task. If the triggering criteria are determined by the local maintenance supervisor on the local controller to be met, the local maintenance supervisor may determine that the maintenance task is to be performed and may execute the maintenance task at 314. For example, the maintenance tasks may be performed at 314 to test system performance, recalibrate control devices, update firmware on control devices, and/or update the system configuration data with control settings for controlling one or more control devices in a load control system.

At 316, the local maintenance supervisor on the local controller may transmit a feedback message that includes the results of one or more maintenance tasks that have been completed. For example, the results may include measurements and/or acknowledgements from the load control devices that have performed the maintenance task. The results may include a time at which the maintenance task completed at each of the load control devices. The results may include a pass/fail indication of a result of a test performed on the one or more control devices. The results of a programming or firmware update may indicate whether one or more control devices are properly operating based on the updates. The local maintenance supervisor on the local controller may transmit the results of the maintenance task after completion (e.g., immediately after completion) of the task or at a predefined time. In some examples, the local maintenance supervisor on the local controller may transmit the results of multiple maintenance tasks at a predefined time. For example, the local maintenance supervisor on the local controller may store the results of one or more maintenance tasks until receiving a request to report the results of the maintenance tasks to the cloud maintenance supervisor. The local maintenance supervisor on the local controller may transmit the results of multiple maintenance tasks in a message together with an identifier of each of the maintenance tasks performed and the corresponding results based on responses from the load control devices being maintained by the local maintenance supervisor.

The cloud maintenance supervisor on the cloud server may receive the one or more feedback messages including the results of the maintenance task(s) at 318. Each local maintenance supervisor may transmit one or more messages with the results of one or more maintenance tasks to the cloud maintenance supervisor. The results of the maintenance tasks may be stored in memory by the cloud maintenance supervisor at one or more cloud servers configured to offer cloud services via the maintenance supervision software. The results of the maintenance tasks may be accessible by the cloud maintenance supervisor. At 320, the cloud maintenance supervisor on the cloud server may transmit a message including an update to a user via a user device. The update may be presented on the maintenance setup screen or other user interface provided by the control/configuration application. The update may include the results of the maintenance task. The message including the update may be sent via an email or another notification to the user. The procedure 300 may end at 322.

Figure 4:
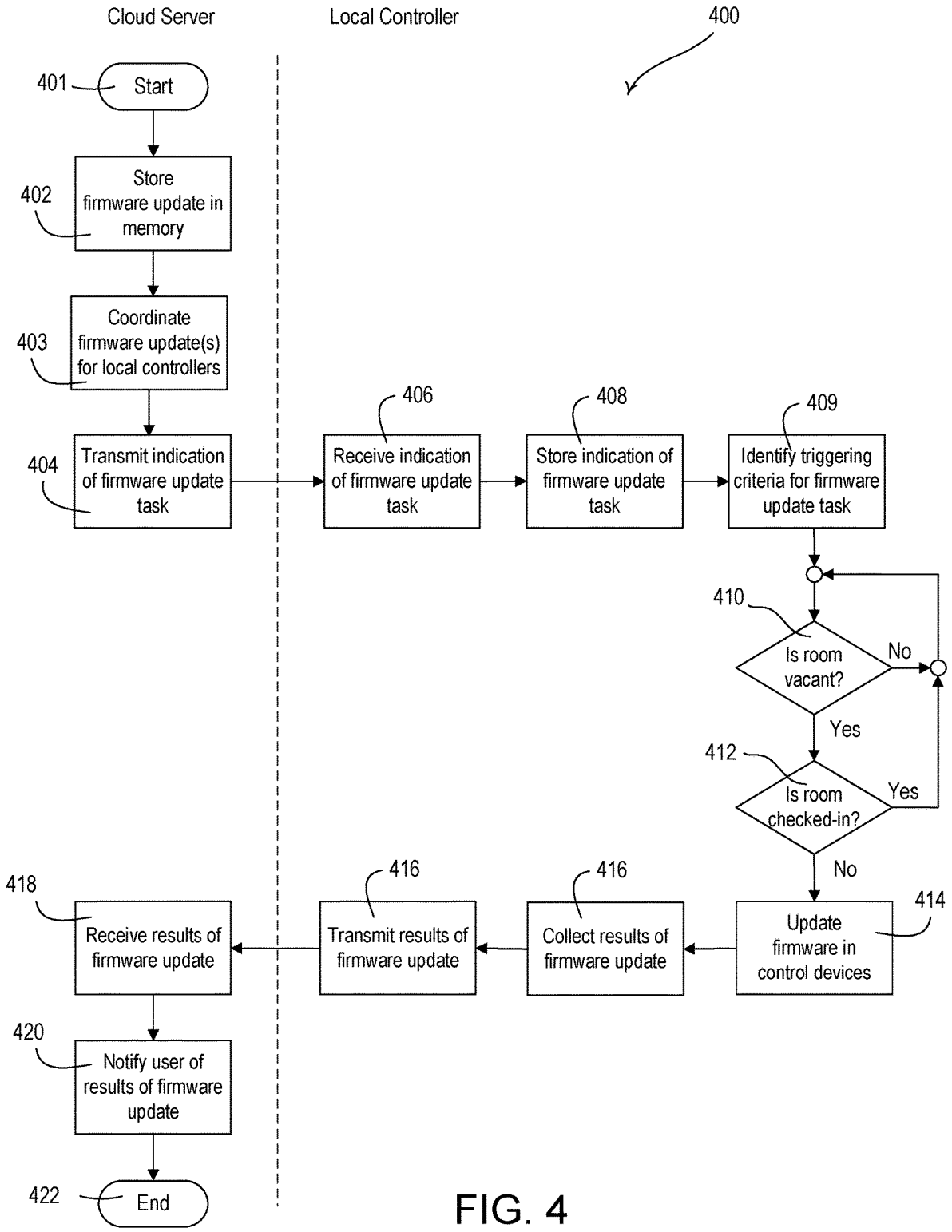
FIG. 4 is a flow diagram of an example procedure that may be performed for applying firmware updates on one or more control devices in a load control system.

FIG. 4 is a flow diagram of an example procedure 400 that may be performed for applying firmware updates on one or more control devices in a load control system. The procedure 400 may be performed by maintenance supervision software that may be executed by one or more control circuits on one or more devices. For example, the maintenance supervision software may be distributed across an application executing on a cloud server operating cloud services and/or one or more local controllers. As described herein, the maintenance supervision software may be executed by one or more control circuits of one or more computing devices for performing one or more portions of the procedure 400. For example, the maintenance supervision software may be configured to operate a cloud maintenance supervisor executing on the cloud server and/or a local maintenance supervisor executing on a local controller. It will be understood that although the procedure 400 shows an example for applying firmware updates when the criteria for certain rules are met (e.g., room is empty and checked out), the procedure 400 may include fewer or additional criteria for completion of one or more rules (e.g., time window, time since a prior firmware update, etc.).

As shown in FIG. 4, the procedure 400 may begin at 401. At 402, the cloud maintenance supervisor on the cloud server may receive and store a new firmware update in memory. The new firmware update may be received at the cloud server for security updates or other firmware updates. At 403, the cloud maintenance supervisor on the cloud server may coordinate the firmware updates for the local controllers. For example, the cloud maintenance supervisor on the cloud server may coordinate the local controllers on which the firmware updates are to be performed. The cloud maintenance supervisor on the cloud server may introduce a priority level or timing offset to certain local controllers for performing the firmware update. This may prevent each of the control devices in the load control system 100 from being inoperable at the same time. In another example, where the firmware updates may cause control devices and/or local controllers to perform communications via RF messages, the prioritization or timing offset for performing the firmware updates at different local controllers may prevent control devices and/or local controllers from all transmitting RF messages at the same time to increase the chances of successful communications (e.g., preventing collisions of messages) communicating on the same RF communication protocol and/or channel.

At 404, the cloud maintenance supervisor on the cloud server may transmit an indication of the firmware update maintenance task to one or more local controllers. The cloud maintenance supervisor on the cloud server may determine the triggering criteria for the firmware update maintenance task and send the triggering criteria with the indication of the firmware update. In another example, the triggering criteria for the firmware update maintenance task may be predefined at each of the local controllers. In the example provided in the procedure 400, the triggering criteria may include a rule that a room or other defined space is vacant and/or checked out for the firmware update to be performed. Though other triggering criteria may be included in the rule. For example, the triggering criteria for a firmware update or a programming update may include a determination that there is a firmware update or programming update to be performed prior to considering any other triggering criteria. The firmware update maintenance task may have been received by the cloud server (e.g., from a user device) which may cause the cloud maintenance supervisor on the cloud server to send an indication to the local servers (e.g., along with the firmware or a location in memory to obtain the firmware at the cloud servers).

At 406, the local maintenance supervisor on a local controller may receive the indication of the firmware update maintenance task and/or the corresponding triggering criteria. For example, each local controller may operate a local maintenance supervisor for supervising the performance of the firmware update by one or more load control devices in the load control system. The local maintenance supervisor for each local controller may receive an indication of the firmware update maintenance task and/or the corresponding triggering criteria from the cloud maintenance supervisor after the creation of one or more maintenance events at the cloud maintenance supervisor. The indication that is received at 406 may include an identifier of the firmware update and/or a location at which the firmware update may be accessed (e.g., a location in storage at the cloud server).

The local maintenance supervisor at the local controller may receive the firmware updates themselves for being downloaded to the control devices. At 408, the local maintenance supervisor on the local controller may store the indication of the firmware update maintenance task in memory. The indication of the firmware update maintenance task and/or the triggering criteria may be stored as a rule for determining when to perform the firmware updates at a later time when firmware updates are available.

The local maintenance supervisor of the local controller may monitor the triggering criteria for the firmware update maintenance task. At 409, the local maintenance supervisor on a local controller may identify the triggering criteria for the firmware update maintenance task. The local maintenance supervisor on the local controller may determine that the triggering criteria include a rule that a room or other defined space is vacant and/or checked out for the firmware update to be performed. At 410, the local maintenance supervisor of the local controller may determine whether the room is vacant. For example, the local maintenance supervisor may receive data from a sensor that indicates an occupancy or vacancy event within a predefined period of time and determine that the room is vacant. At 412, the local maintenance supervisor of the local controller may determine whether the room is in a checked-in status. If the room is not vacant or is in a checked-in status, the local maintenance supervisor of the local controller may continue to monitor the triggering criteria. When the room is determined to be vacant, at 410, and the room is determined to be in a checked-out status, at 412, by the local maintenance supervisor on the local controller, the local maintenance supervisor may update the firmware in one or more control devices when a firmware update is available. The control devices may be updated based on a priority level that indicates a priority of control devices or device types to be updated prior to other control devices or device types. The update in the firmware may be performed by sending a message to the control devices that include an identifier of the firmware update and/or a location at which the firmware update may be accessed (e.g., a location in storage at the cloud server and/or the local controller).

At 415, the local maintenance supervisor of the local controller may collect feedback messages from the control devices that include results of the firmware update. For example, the results may include measurements and/or acknowledgements from the load control devices that have performed the firmware update. The results may include a time at which the firmware update completed at each of the load control devices. The results may include a pass/fail indication of a result of the firmware update performed on the one or more control devices. The results of the firmware update may indicate whether one or more control devices are properly operating based on the update.

The local maintenance supervisor on the local controller may transmit the results of the firmware update at 416 to the cloud maintenance supervisor on the cloud server. The results may be transmitted after completion (e.g., immediately after completion) of the firmware update and/or at a predefined time. In some examples, the local maintenance supervisor on the local controller may transmit the results of the firmware update at a predefined time. For example, the local maintenance supervisor on the local controller may store the results of one or more firmware updates until receiving a request (e.g., from the cloud maintenance supervisor on the cloud server) to report the results of the firmware update to the cloud maintenance supervisor.

The control circuit (e.g., operating the cloud maintenance supervisor) on the cloud server may receive one or more feedback messages including the results of the firmware updates at 418. Each local maintenance supervisor may transmit one or more messages with the results of the firmware updates to the cloud maintenance supervisor. The results of the firmware update may be stored in memory at one or more cloud servers capable of offering cloud services via the maintenance supervision software. The results of the firmware update may be accessible by the cloud maintenance supervisor. At 420, the control circuit (e.g., operating the cloud maintenance supervisor) on the cloud server may transmit a message notifying a user of the results of the firmware update. The update may be presented on a maintenance setup screen or other user interface provided by a control/configuration application. The update may include the results of the firmware update. The message including the update may be sent via an email or another notification to the user. The procedure 400 may end at 422.

Figure 5:
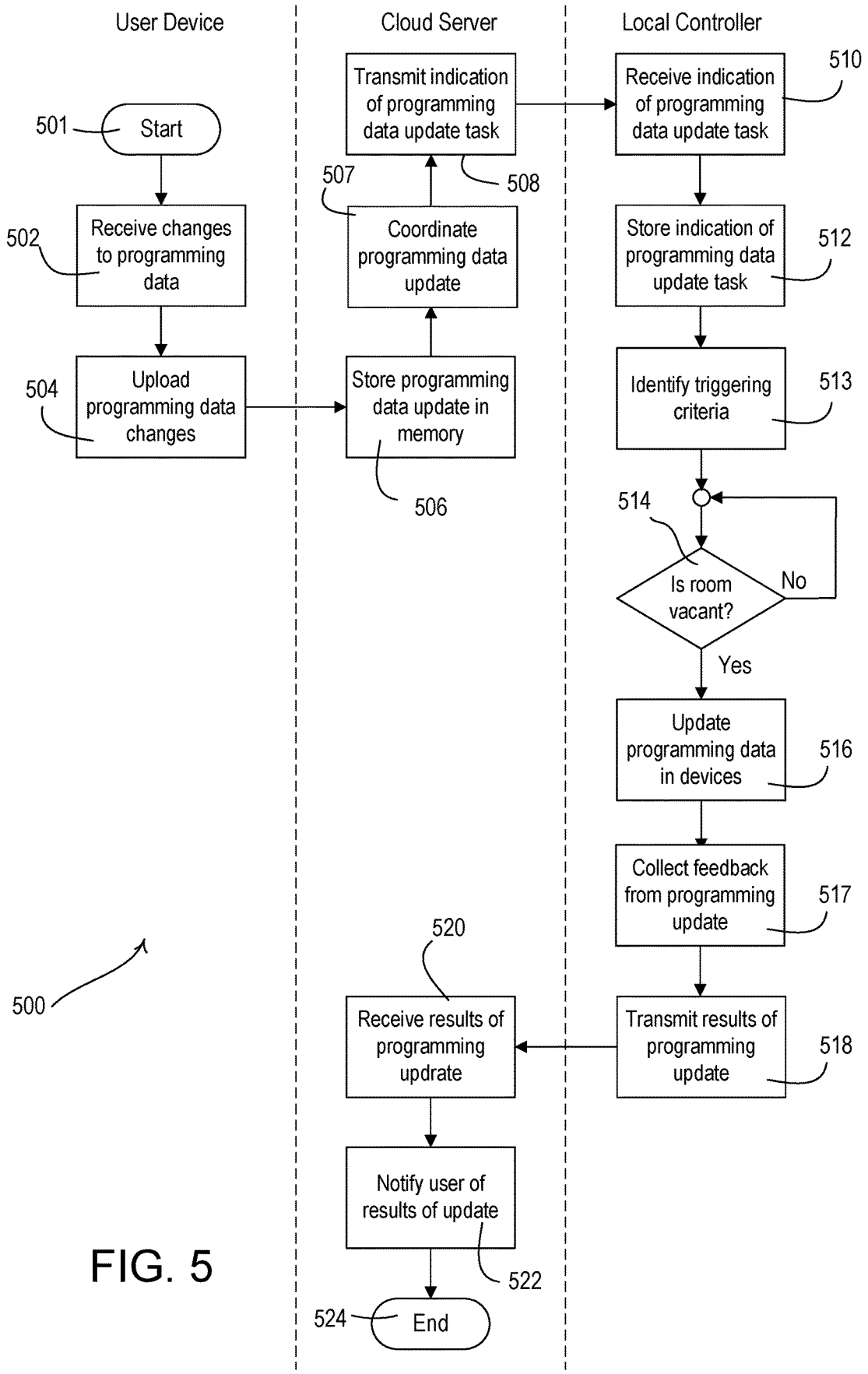
FIG. 5 is a flow diagram of an example procedure that may be performed for applying programming updates on one or more control devices in a load control system.

FIG. 5 is a flow diagram of an example procedure 500 that may be performed for applying programming updates on one or more control devices in a load control system. The procedure 500 may be performed by maintenance supervision software that may be executed by one or more control circuits on one or more devices. For example, the maintenance supervision software may be distributed across an application executing on a user device, a cloud server operating cloud services, and one or more local controllers. As described herein, the maintenance supervision software may be executed by the control circuit of one or more computing devices for performing one or more portions of the procedure 500. For example, the maintenance supervision software may be configured to operate a control/configuration application on a user device, a cloud maintenance supervisor executing on the cloud server, and/or a local maintenance supervisor executing on a local controller. It will be understood that though the procedure 500 shows an example for applying programming updates when the triggering criteria for certain rules are met (e.g., room is vacant), the procedure 500 may include fewer or additional criteria for completion of one or more triggering criteria (e.g., time window, time since a prior programming update, etc.).

As shown in FIG. 5, the procedure 500 may begin at 501. At 502, the control/configuration application on the user device may receive and store changes to the programming data stored in the system configuration data. For example, the user may change control settings in the system configuration data for controlling one or more control devices in one or more defined areas of a building via a graphical user interface displayed on the user device. The changes may include changes to scenes, triggering criteria (e.g., time schedules, sensor events, or other triggering criteria) for controlling electrical loads, and/or other changes to the system configuration data for controlling the one or more electrical loads.

At 504, the control/configuration application on the user device may upload the changes to the programming data to the cloud server. For example, the user may actuate a button on a graphical user interface on the control/configuration application for uploading the changes in the programming data. The control/configuration application may be in communication with or include the maintenance supervision software operating on the cloud server and/or the local controller. The user device may be in direct communication with the cloud server for uploading the changes to the programming data, or the changes to the programming data may be uploaded via one or more other devices, such as the local controller.

At 506, the maintenance supervision software (e.g., the cloud maintenance supervisor) on the cloud server may store the changes to the programming data. At 507, the cloud maintenance supervisor on the cloud server may coordinate the programming updates for the local controllers that are affected by the changes made by the user. For example, the cloud maintenance supervisor on the cloud server may coordinate the local controllers on which the programming updates are to be performed. The cloud maintenance supervisor on the cloud server may introduce a priority level or timing offset to certain local controllers for performing the programming updates. This may prevent each of the control devices in the load control system 100 from being inoperable at the same time. In another example, where the programming updates may cause control devices and/or local controllers to perform communications via RF messages, the prioritization or timing offset for performing the programming updates at different local controllers may prevent control devices and/or local controllers from all transmitting RF messages at the same time to increase the chances of successful communications (e.g., preventing collisions of messages) communicating on the same RF communication protocol and/or channel.

At 508, the cloud maintenance supervisor on the cloud server may transmit an indication of the programming update maintenance task to one or more local controllers. The cloud maintenance supervisor on the cloud server may determine the triggering criteria for the programming update and send the triggering criteria with the indication of the programming update maintenance task. In another example, the triggering criteria for the programming update maintenance task may be predefined at each of the local controllers. In the example provided in the procedure 500, the triggering criteria may include a rule that a room or other defined space is vacant for the programming update to be performed. Though other triggering criteria may be included in the rule.

At 510, the local maintenance supervisor on a local controller may receive the indication of the programming update maintenance task and/or the corresponding triggering criteria. For example, each local controller may operate a local maintenance supervisor for supervising the performance of the programming update by one or more load control devices in the load control system. The local maintenance supervisor for each local controller may receive an indication of the programming update maintenance task and/or the corresponding triggering criteria from the cloud maintenance supervisor after the creation of one or more maintenance events at the cloud maintenance supervisor. The indication that is received at 510 may include an indication of the programming updates and/or a location at which the programming updates may be accessed (e.g., a location in storage at the cloud server). The local maintenance supervisor at the local controller may receive the programming updates themselves for being downloaded to the control devices. At 512, the local maintenance supervisor on the local controller may store the indication of the programming updates in memory. The indication of the programming update and/or the triggering criteria may be stored as a rule for determining when to perform the firmware updates at a later time when firmware updates are available.

The local maintenance supervisor of the local controller may monitor the triggering criteria for the programming update maintenance task. At 513, the local maintenance supervisor on a local controller may identify the triggering criteria for the programming update. The local maintenance supervisor on the local controller may determine that the triggering criteria include a rule that a room or other defined space is vacant or the programming update to be performed. At 514, the local maintenance supervisor of the local controller may determine whether the room is vacant. For example, the local maintenance supervisor may receive data from a sensor that indicates an occupancy or vacancy event within a predefined period of time and determine that the room is vacant. If the room is not vacant, the local maintenance supervisor of the local controller may continue to monitor the triggering criteria. When the room is determined to be vacant, at 514, the local controller may update the programming data at 516 for performing load control based on the control settings stored in one or more control devices. The control devices may be updated at least based on a priority level that indicates a priority of control devices or types of control devices to be updated prior to other control devices or device types. The update in the programming of the control settings may be performed by sending a message to the control devices that include the updated control settings or an identifier of the programming update and/or a location at which the programming update may be accessed (e.g., a location in storage at the cloud server and/or the local controller).

At 517, the local maintenance supervisor of the local controller may collect/receive feedback messages from the control devices that include results of the programming update. For example, the results may include measurements and/or acknowledgements from the load control devices that have performed the programming update. The measurements and/or acknowledgements may indicate control level of load control devices performing control in response to the programming update. The results may include a time at which the programming update completed at each of the load control devices. The results may include a pass/fail indication of a result of the programming update performed on the one or more control devices. The results of the programming update may indicate whether one or more control devices are properly operating based on the update.

The local maintenance supervisor on the local controller may transmit the results of the programming update at 518 to the cloud maintenance supervisor of the cloud server. The results may be transmitted after completion (e.g., immediately after completion) of the programming update and/or at a predefined time. In some examples, local maintenance supervisor on the local controller may transmit the results of the programming update at a predefined time. For example, the local maintenance supervisor on the local controller may store the results of one or more programming updates until a request to report the results of the programming update to the cloud maintenance supervisor is received.

The cloud maintenance supervisor on the cloud server may receive one or more feedback messages including the results of the programming updates at 520. Each local maintenance supervisor on each local controller may transmit one or more messages with the results of the programming updates to the cloud maintenance supervisor. The results of the programming update may be stored in memory at one or more cloud servers configured to offer cloud services via the maintenance supervision software. The results of the programming update may be accessible by the cloud maintenance supervisor. At 522, the cloud maintenance supervisor on the cloud server may transmit one or more messages to the user device notifying a user of the results of the programming update. The update may be presented on a maintenance setup screen or other user interface provided by the control/configuration application. The update may include the results of the programming update. The message including the update may be sent via an email or another notification to the user. The procedure 500 may end at 524.

Figure 6:
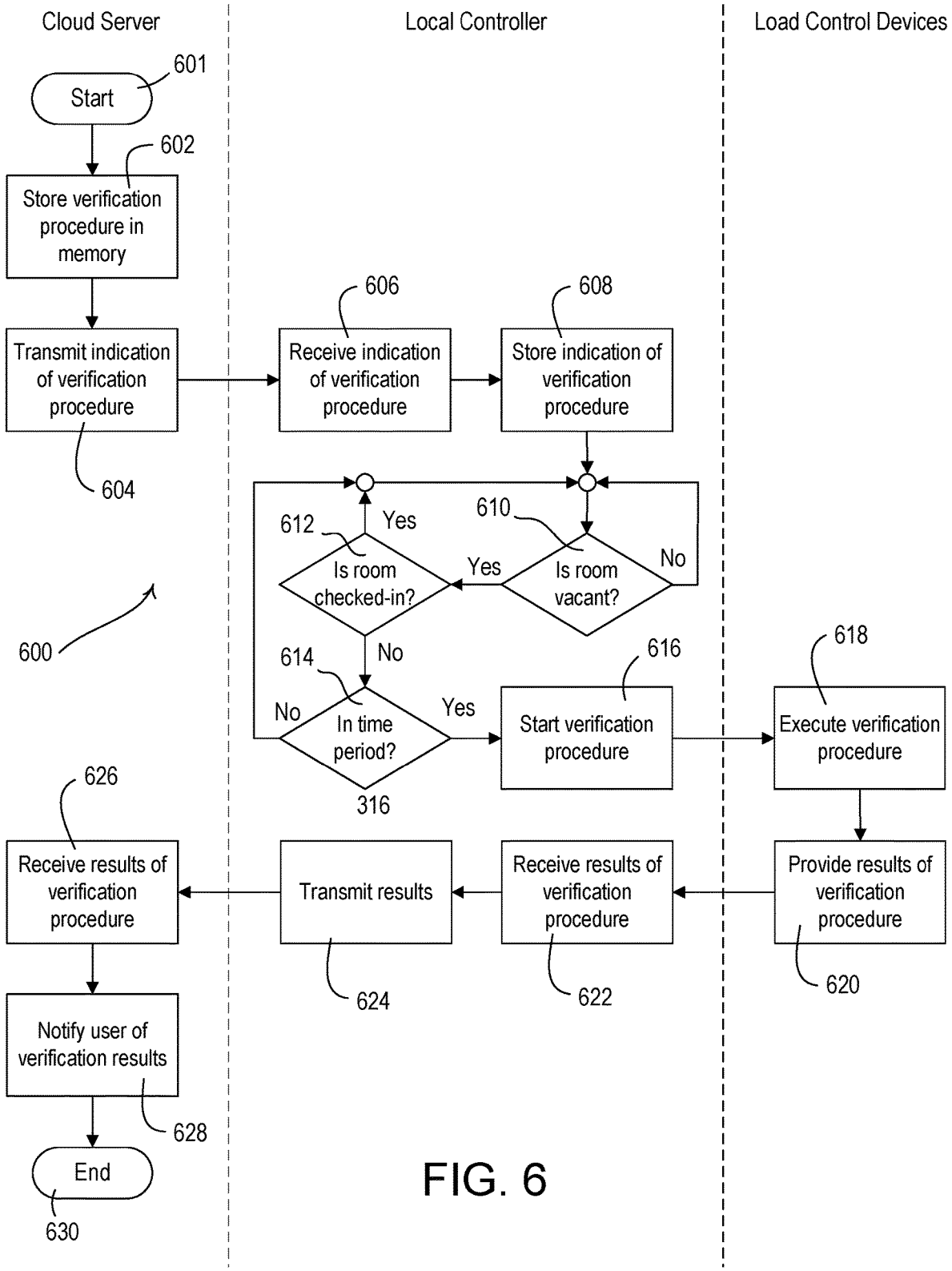
FIG. 6 is a flow diagram of an example procedure that may be performed for verifying the system performance for a configured time window on one or more control devices in a load control system.

FIG. 6 is a flow diagram of an example procedure 600 that may be performed for scheduling testing to verify system performance (e.g., testing to verify the operation of emergency lighting fixtures) for a configured time window on one or more control devices in a load control system. The procedure 600 may be performed by maintenance supervision software that may be executed by one or more control circuits on one or more devices. For example, the maintenance supervision software may be distributed across a cloud server operating cloud services, one or more local controllers, and/or one or more control devices. The maintenance supervision software may be executed by a control/configuration application configured for configuration and/or control of the system configuration data. As described herein, the maintenance supervision software may be executed by the control circuit of one or more computing devices for performing one or more portions of the procedure 600. For example, the maintenance supervision software may be configured to operate a cloud maintenance supervisor executing on the cloud server, a local maintenance supervisor executing on a local controller, and/or an application/firmware on one or more control devices. Though the procedure 600 shows example maintenance task triggering criteria for a single rule being met, the procedure 600 may include additional criteria for completion of one or more additional rules before the maintenance task is performed. Furthermore, though the procedure 600 and other procedures described herein may be performed by local controllers to perform the same maintenance task on one or more rooms of a building (e.g., respective rooms of a hotel), each local controller may execute at different times based on the criteria defining the rules for performing the maintenance task.

As shown in FIG. 6, the procedure 600 may begin at 601. At 602, the cloud maintenance supervisor on the cloud server may receive and store an indication to perform a verification maintenance task in memory. The indication to provide a verification maintenance task may be received at the cloud server for verifying system performance at one or more local controllers 162 that verifies the responsiveness, functionality, and/or status of one or more load control devices. One example of verification of the system performance may be implemented for verifying the performance of lighting control devices installed in emergency lighting fixtures. The verification procedure may be implemented in response to one or more triggering criteria defining the verification maintenance task and configured to initiate the verification procedure at the emergency lighting fixtures to verify the performance of the emergency lighting fixtures.

The cloud maintenance supervisor on the cloud server may coordinate the verification procedure for the local controllers. For example, the cloud maintenance supervisor on the cloud server may coordinate the local controllers on which the verification procedure is to be performed. The cloud maintenance supervisor on the cloud server may introduce a priority level or timing offset to certain local controllers for performing the verification procedure. This may prevent each of the control devices in the load control system 100 from being inoperable at the same time. In another example, where the verification procedure may cause control devices and/or local controllers to perform communications via RF messages, the prioritization or timing offset for performing the verification procedure at different local controllers may prevent control devices and/or local controllers from all transmitting RF messages at the same time to increase the chances of successful communications (e.g., preventing collisions of messages) communicating on the same RF communication protocol and/or channel. Though description is provided herein for coordinating the maintenance tasks of the local controllers with different levels of priority and/or a timing offset, each of the local controllers may perform a maintenance task at the same time or within the same timeframe.

At 604, the cloud maintenance supervisor on the cloud server may transmit an indication of the verification maintenance task for performing system verification via a verification procedure to one or more local controllers. The cloud maintenance supervisor on the cloud server may determine the triggering criteria for the verification maintenance task and send the triggering criteria with the indication of the verification maintenance task. In another example, the triggering criteria for the verification maintenance task may be predefined at each of the local controllers. In the example provided in the procedure 600, the triggering criteria may include a rule that a room or other defined space is vacant, that the room is checked out, and/or that a condition is met for a predefined period of time for the verification procedure to be performed. Though other triggering criteria may be included in the rule.

At 606, the local maintenance supervisor on a local controller may receive the indication of the verification maintenance task and/or the corresponding triggering criteria from the cloud maintenance supervisor of the cloud server. For example, each local controller may operate a local maintenance supervisor for supervising the performance of the verification maintenance task by one or more load control devices in the load control system. The indication that is received at 606 may include an identifier of the verification procedure that is to be performed when different types of verification procedures are supported. For example, the indication may be for a verification procedure to verify the performance of lighting control devices installed in emergency lighting fixtures. The indication may be for a verification procedure to verify proper control after a programming update. At 608, the local maintenance supervisor on the local controller may store the indication of the verification procedure in memory.

The local maintenance supervisor of the local controller may coordinate the performance of the verification procedure for completion of the verification maintenance task after identification of the corresponding triggering criteria. For example, the local maintenance supervisor of the local controller may monitor the triggering criteria for the verification maintenance task for determining execution of the verification procedure at one or more load control devices. The local maintenance supervisor on a local controller may identify the triggering criteria for the verification maintenance task. The local maintenance supervisor on the local controller may determine that the triggering criteria include a rule that a room or other defined space is vacant, that the room or other defined space is checked out, and/or that a condition is met for a predefined period of time for the verification procedure to be performed. For example, at 610, the local maintenance supervisor of the local controller may determine whether the room is vacant. At 612, the local maintenance supervisor of the local controller may determine whether the room is in a checked-in status. At 614, the local maintenance supervisor of the local controller may determine whether the condition of the predefined period of time is met. For example, the local maintenance supervisor may identify whether a period of time has elapsed since a last verification procedure and/or whether a current time is within a predefined period of day, week, month, quarter, or year. If the room is not vacant, is in a checked-in status, and/or the condition for the predefined period of time is not met, the local maintenance supervisor of the local controller may continue to monitor the triggering criteria. When the room is determined to be vacant, at 610, and the room is determined to be in a checked-out status, at 612, and the condition is met for the predefined period of time, at 614, the local controller may determine that the verification procedure should be performed. The control devices may perform the verification procedure based on a priority level that indicates a priority of control devices or device types to be updated prior to other control devices or device types. The verification procedure may be performed by sending a message to the control devices that include an identifier of the verification procedure to be performed (e.g., verification of operation of emergency devices on battery power).

At 616, the local maintenance supervisor of the local controller may initiate the verification procedure at one or more load control devices. For example, the local maintenance supervisor of the local controller may transmit a message that may cause a control circuit of the load control devices to perform the verification procedure appropriate for the control device, at 618. In one example, the verification procedure may be performed to cause the lighting control devices in emergency lighting fixtures to turn on to a predefined intensity level and/or color and operate for at least a predefined period of time or until the battery is discharged (e.g., completely or to a predefined level). The verification procedure may be performed to test whether each of the lighting control devices in an emergency lighting fixture can operate on the battery power for at least a predefined time period. Though other verification procedures may be performed, such as a verification procedure to verify firmware updates, programming updates, or to verify other information or control settings at a control device.

After the control circuit of a load control device executes the verification procedure at 618, the control circuit may store the results of the verification procedure. The results may include measurements and/or acknowledgements of the performance of the verification procedure. In one example, at the end of the performance of the verification procedure at each of the emergency lighting fixtures, the control circuit of the lighting control devices may each send results of the verification procedure to the respective local controller in a feedback message at 620. The results may include an indication of whether the lighting control device was able to operate for the predefined period of time and/or whether the battery discharged (e.g., completely or to a predefined level) before an expiration of the predefined period of time. The results may include an indication of whether the lighting control device is still capable of operating on the battery power after the predefined period of time and/or an estimated amount of time for further operation based on the battery power. The results may include an indication of an amount of remaining battery power after the verification procedure. The results may include a time at which the verification procedure was performed. The results may include a pass/fail indication of a result of the verification procedure performed on the load control device. The results may include an indication of success or failure of the verification procedure based on one or more of the results described herein. The lighting control device may cause the battery to be recharged after the verification procedure.

The local maintenance supervisor on the local controller may collect feedback messages from the control devices that include results of the verification procedure. For example, the results of the verification procedure may be received from each of the load control devices at 622. The local maintenance supervisor on the local controller may transmit the results of the verification procedure to the cloud maintenance supervisor of the cloud server at 624. The results may be transmitted after completion (e.g., immediately after completion) of the verification procedure and/or at a predefined time. In some examples, the local maintenance supervisor on the local controller may transmit the results of the verification procedure at a predefined time. For example, the local maintenance supervisor on the local controller may store the results of one or more verification procedures until receiving a request to report the results of the verification procedure to the cloud maintenance supervisor.

The cloud maintenance supervisor on the cloud server may receive one or more feedback messages including the results of the verification procedure at 626. Each local maintenance supervisor may transmit one or more messages with the results of the verification procedure to the cloud maintenance supervisor. The results of the verification procedure may be stored in memory at one or more cloud servers configured to offer cloud services via the maintenance supervision software. The results of the verification procedure may be accessible by the cloud maintenance supervisor. At 628, the cloud maintenance supervisor on the cloud server may transmit a message notifying the user of the results of the verification procedure. The update may be presented on a maintenance setup screen or other user interface provided by the control/configuration application. The update may include the results of the verification procedure. The message including the update may be sent via an email or another notification to the user. The procedure 600 may end at 630.

Figure 7:
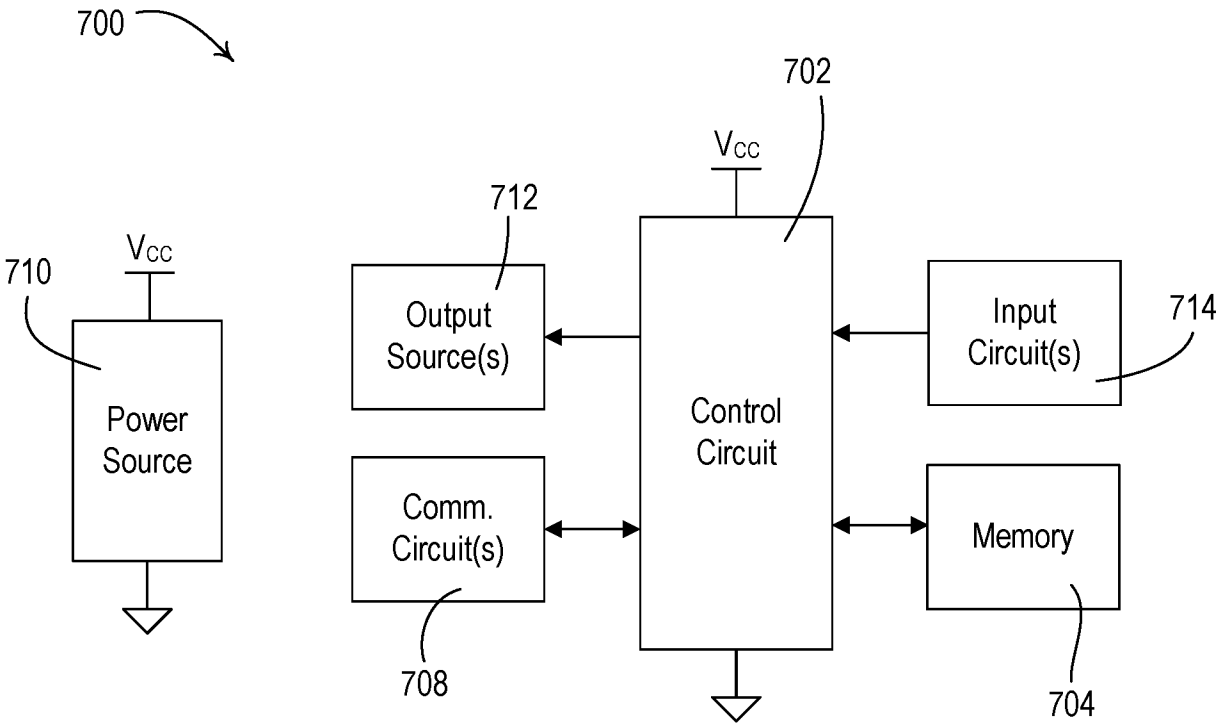
FIG. 7 is a block diagram of an example computing device.

FIG. 7 is a block diagram illustrating an example computing device 700. For example, the computing device 700 may be a user device (such as the user device 128, described herein), a local controller (such as the local controller 162, described herein), a cloud server device (such as the cloud server device 165 operating the cloud services 164, described herein), an input device (such as control device 116, sensor devices 112, 150, or access point 136), and/or another computing device as described herein.

The computing device 700 may include a control circuit 702 for controlling the functionality of the computing device 700. The control circuit 702 may include one or more general purpose processors, special purpose processors, conventional processors, digital signal processors (DSPs), microprocessors, integrated circuits, a programmable logic device (PLD), application specific integrated circuits (ASICs), or the like. The control circuit 702 may perform signal coding, data processing, image processing, power control, input/output processing, or any other functionality that enables the computing device 700 to perform as one of the computing devices of the load control system (e.g., load control system 100) described herein.

The control circuit 702 may be communicatively coupled to a memory 704 to store information in and/or retrieve information from the memory 704. The memory 704 may include a non-removable memory and/or a removable memory. The non-removable memory may include random-access memory (RAM), read-only memory (ROM), a hard disk, or any other type of non-removable memory storage.

The removable memory may include a subscriber identity module (SIM) card, a memory stick, a memory card, or any other type of removable memory. The memory 704 may be implemented as an external integrated circuit (IC) or as an internal circuit of the control circuit 702. The memory 704 may include computer-readable or machine-readable instructions configured to be executed by the control circuit 702 to perform as described herein.

The computing device 700 may include one or more communication circuits 708 that are in communication with the control circuit 702 for sending and/or receiving information as described herein. The communication circuit 708 may perform wireless and/or wired communications. The communication circuit 708 may be a wired communication circuit configured to communicate on a wired communication link. The wired communication link may include an Ethernet communication link, an RS-485 serial communication link, a 0-10 volt analog link, a Digital Addressable Lighting Interface (DALI) digital communication link, and/or another wired communication link. The communication circuit 708 may be configured to communicate via power lines (e.g., the power lines from which the computing device 700 receives power) using a power line carder (PLC) communication technique. The communication circuit 708 may be a wireless communication circuit including one or more RF transmitters, receivers, transceivers, or other communication circuit configured to perform wireless communications.

Though a single communication circuit 708 may be illustrated, multiple communication circuits may be implemented in the computing device 700. The computing device 700 may include a communication circuit configured to communicate via one or more wired and/or wireless communication protocols and at least one other communication circuit configured to communicate via one or more other wired and/or wireless communication protocols. For example, a first communication circuit may be configured to communicate via a wired or wireless communication link, while another communication circuit may be configured to communicate on another wired or wireless communication link. The first communication circuit may be configured to communicate via a first wireless communication protocol on a network communication link and the second communication circuit may be configured to communicate via a second wireless communication protocol on a short-range communication link or a direct communication link.

The control circuit 702 may be in communication with one or more input circuits 714 from which input may be received. The input circuits 714 may be included in a user interface for receiving input from the user. For example, the input circuits 714 may include an actuator (e.g., one or more physical buttons) that may be actuated by a user to communicate user input or selections to the control circuit 702. The actuator may be actuated to put the control circuit 702 in an association mode and/or communicate association messages from the computing device 700 or signal other information to the control circuit 702. The actuator may be actuated to perform control by transmitting control instructions indicating the actuation on the user interface and/or the control instructions generated in response to the actuation. The actuator may include a touch sensitive surface, such as a capacitive touch surface, a resistive touch surface an inductive touch surface, a surface acoustic wave (SAW) touch surface, an infrared touch surface, an acoustic pulse touch surface, or another touch sensitive surface that is configured to receive inputs (e.g., touch actuations/inputs), such as point actuations or gestures from a user. The control circuit 702 of the computing device 700 may enter the association mode, transmit an association message, transmit control instructions, or perform other functionality in response to an actuation or input from the user on the touch sensitive surface.

The input circuits 714 may include a sensor circuit (e.g., a sensor). The sensor circuit may be an occupant sensing circuit, a light sensing circuit (e.g., an ambient light sensing circuit, a daylight sensing circuit, and/or a photo-sensing circuit), a temperature sensor circuit, a color temperature sensing circuit, a visible light sensing circuit (e.g., an image recording circuit, such as a camera), and/or another sensing circuit for receiving input (e.g., sensing an environmental characteristic in the environment of the computing device 700). The control circuit 702 may receive information from the one or more input circuits 714 and process the information for performing functions as described herein.

The control circuit 702 may be in communication with one or more output sources 712. The output sources 712 may include one or more indicators (e.g., visible indicators, such as LEDs) for providing indications (e.g., feedback) to a user. The output sources 712 may include a display (e.g., a visible display) for providing information (e.g., feedback) to a user. The control circuit 702 and/or the display may generate a graphical user interface (GUI) generated via software for being displayed on the computing device 700 (e.g., on the display of the computing device 700).

Each hardware component within the computing device 700 may be powered by a power source 710. The power source 710 may include an AC power supply or DC power supply, for example. The power source 710 may generate a supply voltage $V_{CC}$ for powering the hardware components within the computing device 700.

Figure 8:
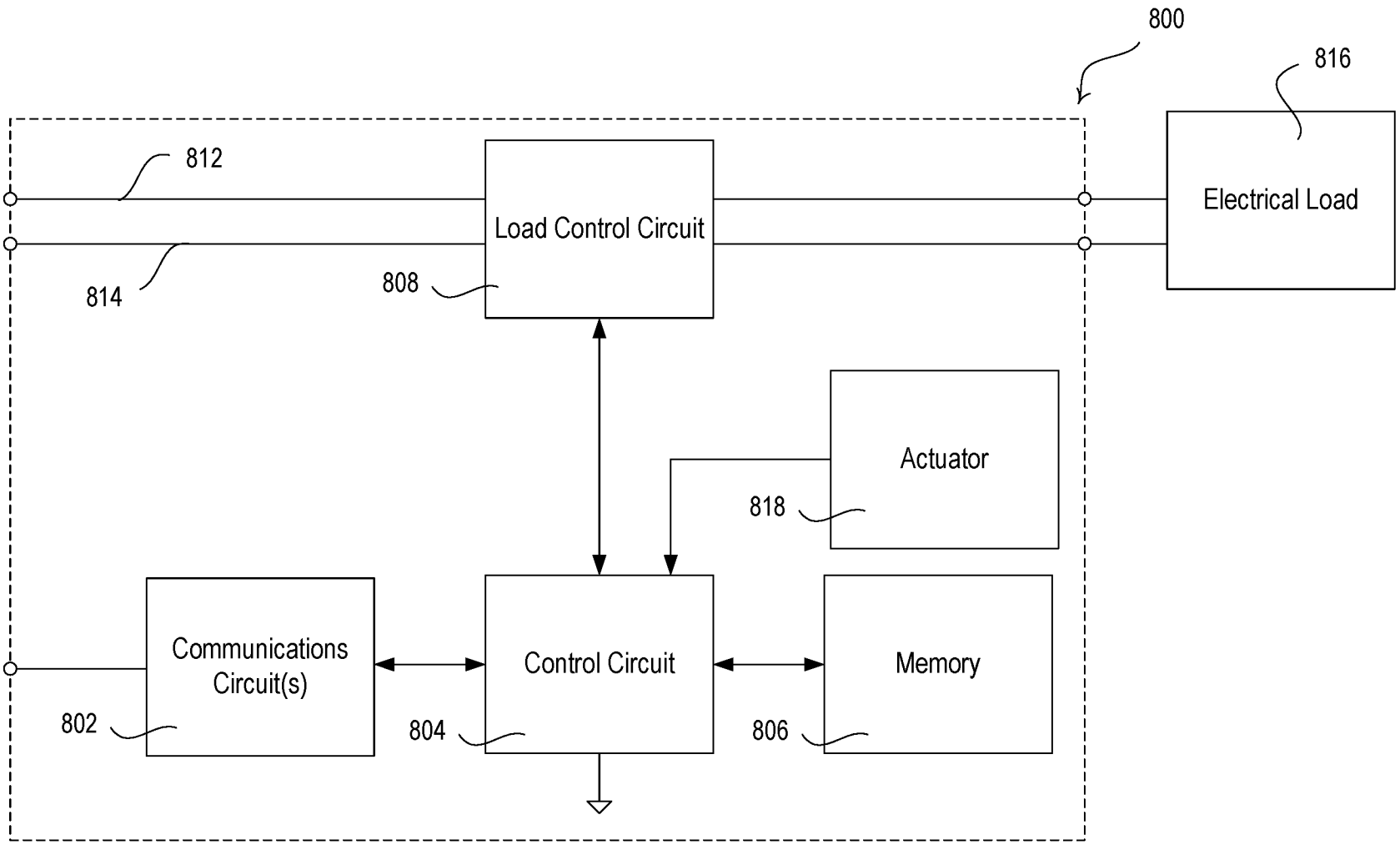
FIG. 8 is a block diagram of an example load control device.

FIG. 8 is a block diagram illustrating an example load control device, e.g., a load control device 800, as described herein. The load control device 800 may be a lighting control device, such as a dimmer switch, an electronic switch, an electronic ballast for lamps, an LED driver for LED light sources, or another lighting control device. The load control device 800 may be an AC plug-in load control device for controlling a plugged electrical load, a controllable electrical receptacle, a temperature control device (e.g., a thermostat), a motor drive unit for a motorized window treatment, a motor drive unit for a fan (e.g., ceiling fan), an audio device (e.g., a controllable speaker or playback device), an appliance, a security camera device, and/or other load control device.

The load control device 800 may include a communications circuits 802. The communications circuits 802 may include a receiver, an RF transceiver, or other communications circuit configured to perform wired and/or wireless communications via a communications link. The wired communication link may include an Ethernet communication link, an RS-485 serial communication link, a 0-10 volt analog link, a Digital Addressable Lighting Interface (DALI) digital communication link, and/or another wired communication link. Though a single communication circuit 802 may be illustrated, multiple communication circuits may be implemented in the load control device 800. The load control device 800 may include a communication circuit configured to communicate via one or more wired and/or wireless communication protocols and at least one other communication circuit configured to communicate via one or more other wired and/or wireless communication protocols. For example, a first communication circuit may be configured to communicate via a wired or wireless communication link, while another communication circuit may be configured to communicate on another wired or wireless communication link. The first communication circuit may be configured to communicate via a first wireless communication protocol on a network communication link and the second communication circuit may be configured to communicate via a second wireless communication protocol on a short-range communication link or a direct communication link.

The communications circuit 802 may be in communication with a control circuit 804. The control circuit 804 may include one or more general purpose processors, special purpose processors, conventional processors, digital signal processors (DSPs), microprocessors, integrated circuits, a programmable logic device (PLD), application specific integrated circuits (ASICs), or the like. The control circuit 804 may perform signal coding, data processing, power control, input/output processing, or any other functionality that enables the load control device 800 to perform as described herein.

The control circuit 804 may store information in and/or retrieve information from the memory 806. For example, the memory 806 may maintain a registry of associated control devices and/or control settings/configuration instructions for responding to triggering events or other control instructions. The memory 806 may include a non-removable memory and/or a removable memory. The memory 806 may include computer-readable or machine-readable instructions configured to be executed by the control circuit 804 to perform as described herein. The load control circuit 808 may receive instructions from the control circuit 804 and may control the electrical load 816 based on the received instructions. The load control circuit 808 may send status feedback to the control circuit 804 regarding the status of the electrical load 816. The load control circuit 808 may receive power via the hot connection 812 and the neutral connection 814 and may provide an amount of power to the electrical load 816. The electrical load 816 may include any type of electrical load.

The control circuit 804 may be in communication with an actuator 818 (e.g., one or more buttons) that may be actuated by a user to communicate user selections to the control circuit 804. For example, the actuator 818 may be actuated to put the control circuit 804 in an association mode and/or communicate association messages from the load control device 800.

Although features and elements are described herein in particular combinations, each feature or element can be used alone or in any combination with the other features and elements. The methods described herein may be implemented in a computer program, software, instructions, or firmware stored on one or more non-transitory computer-readable media or other machine-readable media for execution by a computer or machine, or portion thereof. For example, the computer-readable or machine-readable media may be executed by a control circuit, such as a processor. Examples of computer-readable media or machine-readable media include electronic signals (transmitted over wired or wireless connections) and computer-readable storage media. Examples of computer-readable storage media include, but are not limited to, a read only memory (ROM), a random access memory (RAM), removable disks, and optical media such as CD-ROM disks, and digital versatile disks (DVDs). The control circuit may access the computer program, software, instructions, or firmware stored on the computer-readable media or machine-readable media for being executed to cause the control circuit to operate as described herein, or to operate one or more devices as described herein.

What is claimed is:

1. A method for performing at least one maintenance task on a plurality of load control devices in a load control system, the method comprising:

receiving, at a local controller of a plurality of local controllers that are configured to control the plurality of load control devices, an indication of a first maintenance task to be performed on the plurality of load control devices, wherein:

the local controller is configured to control a first one or more load control devices of the plurality of load control devices, the first one or more load control devices are located in a first area of a building, the other local controllers of the plurality of local controllers are configured to control the remaining plurality of load control devices, the remaining plurality of load control devices are located in one or more other areas of the building, the indication of the first maintenance task is received from a cloud maintenance supervisor operating at a cloud server and is configured to be received by each of the plurality of local controllers for performance of the first maintenance task on the plurality of load control devices, and the indication of the first maintenance task includes one or more first triggering criteria associated with at least one first rule for performance of the first maintenance task at each of the plurality of local controllers;

identifying, at a local maintenance supervisor operating at the local controller, the one or more first triggering criteria for triggering a performance of the first maintenance task on the first one or more load control devices of the plurality of load control devices configured to be controlled by the local controller;

determining, at the local maintenance supervisor operating at the local controller, that the one or more first triggering criteria associated with the at least one first rule are met;

determining, based on the one or more first triggering criteria associated with the at least one first rule for performance of the first maintenance task and one or more second triggering criteria associated with at least one second rule for performance of a second maintenance task at the local controller, a conflict in performance of the first maintenance task and the second maintenance task on the first one or more load control devices of the plurality of load control devices configured to be controlled by the local controller;

prioritizing the performance of the first maintenance task over the second maintenance task on the first one or more load control devices of the plurality of load control devices configured to be controlled by the local controller;

performing the first maintenance task on the first one or more load control devices configured to be controlled by the local controller;

determining results of the first maintenance task performed on the first one or more load control devices controlled by the local controller; and sending the results of the first maintenance task to the cloud maintenance supervisor operating at the cloud server.

2. The method of claim 1, wherein the first area and the one or more other areas of the building comprise different rooms of the building.

3. The method of claim 1, wherein the local controller is a first local controller, wherein the local maintenance supervisor is a first local maintenance supervisor, the method further comprising:

receiving the first maintenance task at a second local controller of the plurality of local controllers configured to control a second one or more load control devices of the plurality of load control devices in a second area of the building;

identifying, at a second local maintenance supervisor of the second local controller, the one or more first triggering criteria associated with the at least one first rule for triggering the performance of the first maintenance task on the second one or more load control devices configured to be controlled by the second local controller;

determining, at the second local maintenance supervisor of the second local controller, that the one or more first triggering criteria associated with the at least one first rule are met;

performing the first maintenance task on the second one or more load control devices configured to be controlled by the second local controller;

determining results of the first maintenance task performed on the second one or more load control devices; and sending the results of the first maintenance task performed on the second one or more load control devices configured to be controlled by the second local controller to the cloud maintenance supervisor.

4. The method of claim 1, further comprising:

determining, at the cloud maintenance supervisor, that a maintenance event has been scheduled in response to input from a user device, wherein the maintenance event comprises the first maintenance task and the one or more first triggering criteria; and transmitting the first maintenance task and the one or more first triggering criteria from the cloud maintenance supervisor to the local maintenance supervisor on the local controller.

5. The method of claim 1, wherein the first maintenance task comprises at least one of a programming update, a firmware update, testing to verify system performance, or a recalibration procedure.

6. The method of claim 5, wherein the one or more first triggering criteria comprise one or more of a checked-in status, an occupancy status, a time of day, a period of time since last occupancy, a period of time since a change in the checked-in status, a period of time since last performance of the first maintenance task, an indication of an override, a daylight intensity value, a temperature of a room, a temperature outside of the room or the building, a lighting intensity value, a status of a load control device, a status of an electrical load, or a status of an occupant.

7. The method of claim 1, wherein the one or more first triggering criteria comprise an occupancy status of the first area of the building, and wherein the one or more first triggering criteria are determined to be met when the first area of the building is determined to be unoccupied in response to data received from an occupancy sensor.

8. The method of claim 1, wherein the one or more first triggering criteria comprise a checked-in status of the areas of the building, and wherein the one or more first triggering criteria are determined to be met when the checked-in status of the areas of the building indicate that the areas are checked out.

9. The method of claim 1, wherein the first maintenance task comprises testing to verify system performance, and wherein each load control device of the plurality of load control devices comprises a lighting device installed in an emergency lighting fixture.

10. The method of claim 9, wherein the one or more first triggering criteria comprise at least one of a checked-in status, an occupancy status, or a period of time since last performance of the first maintenance task.

11. The method of claim 1, wherein the first maintenance task comprises a programming update or a firmware update, and wherein the one or more first triggering criteria comprise at least one of a checked-in status or an occupancy status.

12. The method of claim 1, wherein the one or more first triggering criteria comprise an occupancy status, the method further comprising:

determining, at the local maintenance supervisor of the local controller, the occupancy status based on data from a sensor located in the first area;

wherein, when the occupancy status indicates that the first area is unoccupied, the first maintenance task is performed on the first one or more load control devices configured to be controlled by the local controller; and wherein, when the occupancy status indicates that the first area is occupied, the first maintenance task is performed on the first one or more load control devices configured to be controlled by the local controller at a later time when the first area is determined to be unoccupied.

13. The method of claim 12, wherein the one or more first triggering criteria comprise a predefined time of day, the method further comprising:

determining, at the local maintenance supervisor of the local controller, a current time of day;

wherein, when the current time of day is within the predefined time of day and the occupancy status indicates that the first area is unoccupied, the first maintenance task is performed on the first one or more load control devices configured to be controlled by the local controller; and wherein, when the current time of day is outside of the predefined time of day or the occupancy status indicates that the first area is occupied, the maintenance task is performed on the first one or more load control devices configured to be controlled by the local controller at a later time when the current time of day is within the predefined time of day and the first area is determined to be unoccupied.

14. A local controller configured to control one or more load control devices in an area of a building in which a load control system is installed, the local controller comprising:

a communication circuit; and at least one control circuit configured to:

receive, via the communication circuit from a cloud maintenance supervisor operating at a cloud server, an indication of a first maintenance task to be performed on the one or more load control devices, and wherein the indication of the first maintenance task includes one or more first triggering criteria associated with at least one first rule for performance of the first maintenance task;

identify the one or more first triggering criteria for triggering the performance of the first maintenance task on the one or more load control devices configured to be controlled by the local controller;

determine that the one or more first triggering criteria has been met;

determine, based on the one or more first triggering criteria associated with the at least one first rule for performance of the first maintenance task and one or more second triggering criteria associated with at least one second rule for performance of a second maintenance task to be performed on the one or more load control devices, a conflict in performance of the first maintenance task and the second maintenance task on the one or more load control devices configured to be controlled by the local controller;

prioritize the performance of the first maintenance task over the second maintenance task on the one or more load control devices configured to be controlled by the local controller;

perform the first maintenance task on the one or more load control devices configured to be controlled by the local controller;

determine results of the first maintenance task performed on the one or more load control devices configured to be controlled by the local controller; and send the results of the first maintenance task to the cloud maintenance supervisor operating at the cloud server.

15. The local controller of claim 14, wherein the area of the building comprises a room of the building.

16. The local controller of claim 14, wherein the first maintenance task comprises at least one of a programming update, a firmware update, testing to verify system performance, or a recalibration procedure.

17. The local controller of claim 16, wherein the one or more first triggering criteria comprise one or more of a checked-in status, an occupancy status, a time of day, a period of time since last occupancy, a period of time since a change in the checked-in status, a period of time since last performance of the first maintenance task, an indication of an override, a daylight intensity value, a temperature of a room, a temperature outside of the room or the building, a lighting intensity value, a status of a load control device, a status of an electrical load, or a status of an occupant.

18. The local controller of claim 14, wherein the one or more first triggering criteria comprise an occupancy status of the area of the building, and wherein the one or more first triggering criteria are determined to be met when the area of the building is determined to be unoccupied in response to data received from an occupancy sensor.

19. The local controller of claim 14, wherein the one or more first triggering criteria comprise a checked-in status of the area of the building, and wherein the at least one control circuit is configured to determine that the one or more first triggering criteria are met when the checked-in status of the area of the building indicates that the area is checked out.

20. The local controller of claim 14, wherein the first maintenance task comprises testing to verify system performance, and wherein each load control device of the plurality of load control devices comprises a lighting device installed in an emergency lighting fixture.

21. The local controller of claim 20, wherein the one or more first triggering criteria comprise at least one of a checked-in status, an occupancy status, or a period of time since last performance of the first maintenance task.

22. The local controller of claim 14, wherein the first maintenance task comprises a programming update or a firmware update, and wherein the one or more first triggering criteria comprise at least one of a checked-in status or an occupancy status.

23. The local controller of claim 14, wherein the one or more load control devices are within a plurality of load control devices configured to be controlled by a plurality of different local controllers in the load control system, and wherein the indication of the first maintenance task is configured to be received by each of the plurality of different local controllers.

24. At least one computer-readable storage medium having computer-executable instructions stored thereon that, when executed by at least one control circuit, cause the at least one control circuit to:

receive, at a local controller of a plurality of local controllers that are configured to control a plurality of load control devices, an indication of a first maintenance task to be performed on the plurality of load control devices, wherein:

the local controller is configured to control a first one or more load control devices of the plurality of load control devices, the first one or more load control devices are located in a first area of a building, the other local controllers of the plurality of local controllers are configured to control the remaining plurality of the load control devices, the remaining plurality of load control devices are located in one or more other areas of the building, the indication of the first maintenance task is received from a cloud maintenance supervisor operating at a cloud server and is configured to be received by each of the plurality of local controllers for performance of the first maintenance task on the plurality of load control devices, and the indication of the first maintenance task includes one or more first triggering criteria associated with at least one first rule for performance of the first maintenance task at each of the plurality of local controllers;

identify, at a local maintenance supervisor operating at the local controller, the one or more first triggering criteria for triggering a performance of the first maintenance task on the first one or more load control devices of the plurality of load control devices configured to be controlled by the local controller;

determine, at the local maintenance supervisor operating at the local controller, that the first one or more triggering criteria associated with the at least one first rule are met;

determine, based on the one or more first triggering criteria associated with the at least one first rule for performance of the first maintenance task and one or more second triggering criteria associated with at least one second rule for performance of a second maintenance task at the local controller, a conflict in performance of the first maintenance task and the second maintenance task on the first one or more load control devices of the plurality of load control devices configured to be controlled by the local controller;

prioritize performance of the first maintenance task over the second maintenance task on the one or more load control devices of the plurality of load control devices configured to be controlled by the local controller;

perform the first maintenance task on the first one or more load control devices configured to be controlled by the local controller;

determine results of the first maintenance task performed on the first one or more load control devices configured to be controlled by the local controller; and send the results of the first maintenance task to the cloud maintenance supervisor operating at the cloud server.

25. The at least one computer-readable storage medium of claim 24, wherein the first area and the one or more other areas of the building comprise different rooms of the building.

26. The at least one computer-readable storage medium of claim 24, wherein the local controller is a first local controller, wherein the local maintenance supervisor is a first local maintenance supervisor, the computer-executable instructions being further configured to cause the at least one control circuit to:

receive the first maintenance task at a second local controller of the plurality of local controllers configured to control a second one or more load control devices of the plurality of load control devices in a second area of the building;

identify, at a second local maintenance supervisor of the second local controller, the one or more first triggering criteria for triggering the performance of the first maintenance task on the second one or more load control devices configured to be controlled by the second local controller;

determine, at the second local maintenance supervisor of the second local controller, that the first triggering criteria associated with the at least one first rule has been met;

perform the first maintenance task on the second one or more load control devices configured to be controlled by the second local controller;

determine results of the first maintenance task performed on the second one or more load control devices; and send the results of the first maintenance task performed on the second one or more load control devices configured to be controlled by the second local controller to the cloud maintenance supervisor.

27. The at least one computer-readable storage medium of claim 24, the computer-executable instructions being further configured to cause the at least one control circuit to:

determine, at the cloud maintenance supervisor, that a maintenance event has been scheduled in response to input from a user device, wherein the maintenance event comprises the first maintenance task and the one or more first triggering criteria; and transmit the first maintenance task and the one or more first triggering criteria from the cloud maintenance supervisor to the local maintenance supervisor on the local controller.

28. The at least one computer-readable storage medium of claim 24, wherein the first maintenance task comprises at least one of a programming update, a firmware update, testing to verify system performance, or a recalibration procedure.

29. The at least one computer-readable storage medium of claim 28, wherein the one or more first triggering criteria comprise one or more of a checked-in status, an occupancy status, a time of day, a period of time since last occupancy, a period of time since a change in the checked-in status, a period of time since last performance of the first maintenance task, an indication of an override, a daylight intensity value, a temperature of a room, a temperature outside of the room or the building, a lighting intensity value, a status of a load control device, a status of an electrical load, or a status of an occupant.

30. The at least one computer-readable storage medium of claim 24, wherein the one or more first triggering criteria comprise an occupancy status of the first area of the building, the computer-executable instructions are further configured to cause the at least one control circuit to determine that the one or more first triggering criteria are met when the first area of the building is unoccupied in response to data received from an occupancy sensor.

31. The at least one computer-readable storage medium of claim 24, wherein the one or more first triggering criteria comprise a checked-in status of the first area of the building, the computer-executable instructions being further configured to cause the at least one control circuit to determine that the one or more first triggering criteria are met when the checked-in status of the first area of the building indicates that the first area is checked out.

32. The at least one computer-readable storage medium of claim 24, wherein the first maintenance task comprises testing to verify system performance, and wherein each load control device of the plurality of load control devices comprises a lighting device configured to control an emergency lighting fixture.

33. The at least one computer-readable storage medium of claim 32, wherein the one or more first triggering criteria comprise at least one of a checked-in status, an occupancy status, or a period of time since last performance of the first maintenance task.

34. The at least one computer-readable storage medium of claim 24, wherein the first maintenance task comprises a programming update or a firmware update, and wherein the one or more first triggering criteria comprise at least one of a checked-in status or an occupancy status.

35. The at least one computer-readable storage medium of claim 24, wherein the one or more first triggering criteria comprise an occupancy status, the computer-executable instructions being further configured to cause the at least one control circuit to:

determine, at the local maintenance supervisor of the local controller, the occupancy status based on data from a sensor located in the first area;

wherein, when the occupancy status indicates that the first area is unoccupied, the instructions are configured to cause the control circuit to perform the first maintenance task on the first one or more load control devices configured to be controlled by the local controller; and wherein, when the occupancy status indicates that the first area is occupied, the instructions are configured to cause the control circuit to perform the first maintenance task on the first one or more load control devices configured to be controlled by the local controller at a later time when the first area is determined to be unoccupied.

36. The at least one computer-readable storage medium of claim 24, wherein the one or more triggering criteria comprise a predefined time of day, the computer-executable instructions being further configured to cause the at least one control circuit to:

determine, at the local maintenance supervisor of the local controller, a current time of day;

wherein, when the current time of day is within the predefined time of day and the occupancy status indicates that the first area is unoccupied, the instructions are configured to cause the control circuit to perform the first maintenance task on the first one or more load control devices configured to be controlled by the local controller; and wherein, when the current time of day is outside of the predefined time of day or the occupancy status indicates that the first area is occupied, the instructions are configured to cause the control circuit to perform the first maintenance task on the first one or more load control devices configured to be controlled by the local controller at a later time when the current time of day is within the predefined time of day and the first area is determined to be unoccupied.

* * * * *